US008372478B1

(12) United States Patent
Harris et al.

(10) Patent No.: US 8,372,478 B1
(45) Date of Patent: Feb. 12, 2013

(54) METHOD FOR POWDER COATING AND DECORATIVE PRINTING

(75) Inventors: Joel D. Harris, Grand Blanc, MI (US); Brian J. Anderson, Goodrich, MI (US)

(73) Assignee: Grace Engineering Corp., Memphis, MI (US)

( * ) Notice: Subject to any disclaimer, the term of this patent is extended or adjusted under 35 U.S.C. 154(b) by 294 days.

(21) Appl. No.: 12/837,178

(22) Filed: Jul. 15, 2010

Related U.S. Application Data

(60) Provisional application No. 61/225,720, filed on Jul. 15, 2009, provisional application No. 61/245,142, filed on Sep. 23, 2009.

(51) Int. Cl.
*B05D 1/12* (2006.01)
*B05D 1/06* (2006.01)
*B05D 1/38* (2006.01)

(52) U.S. Cl. ..... 427/197; 427/195; 427/202; 427/265; 427/469; 427/470

(58) Field of Classification Search ..... 427/195, 427/197, 202, 265, 469, 470
See application file for complete search history.

(56) References Cited

U.S. PATENT DOCUMENTS

| | | | | |
|---|---|---|---|---|
| 2,844,489 | A | 7/1958 | Gemmer | |
| 5,110,617 | A * | 5/1992 | Gundling et al. | 427/469 |
| 5,131,350 | A | 7/1992 | Buschor | |
| 5,308,426 | A | 5/1994 | Claveau | |
| 5,399,198 | A | 3/1995 | Ghaisas | |
| 5,798,017 | A | 8/1998 | Claveau | |
| 5,893,964 | A | 4/1999 | Claveau | |
| 5,962,368 | A | 10/1999 | Poole | |
| 6,620,463 | B2 * | 9/2003 | Stay | 427/458 |
| 6,935,230 | B1 | 8/2005 | Walker et al. | |
| 6,953,511 | B2 | 10/2005 | Bowles, Jr. et al. | |
| 7,238,394 | B2 | 7/2007 | Morita et al. | |
| 7,364,520 | B2 * | 4/2008 | Chauvin et al. | 473/566 |
| 2008/0058133 | A1 * | 3/2008 | Eastman et al. | 473/578 |

FOREIGN PATENT DOCUMENTS

JP 2006-061812 * 3/2006

* cited by examiner

*Primary Examiner* — Frederick Parker
(74) *Attorney, Agent, or Firm* — Warner Norcross & Judd LLP

(57) ABSTRACT

A method is provided for surface treating a substrate utilizing powder coating so that the substrate can be adorned with a decorative pattern and/or color, and can have a durable, aesthetically appealing finish. The decorative pattern can be applied via transfer printing processes, for example, by a sublimation process or a hydrographic process. The method optionally can be used to produce a visually perceivable transition between a decorative pattern, for example, a camouflage pattern, and a generally solid color on the substrate. The transition can be gradual, so that the decorative pattern appears to fade into the generally solid color to provide an appealing visual effect on a product. The method can be used to surface treat a variety of products, for example, archery products and/or firearm products.

19 Claims, 13 Drawing Sheets

METHOD FOR POWDER COATING AND DECORATIVE PRINTING

BACKGROUND OF THE INVENTION

This application claims benefit to U.S. Provisional Patent Application 61/225,720, filed Jul. 15, 2009 and U.S. Provisional Patent Application 61/245,142, filed Sep. 23, 2009, both of which are incorporated by reference herein.

The present invention relates to a method for surface treating and optionally decorating a substrate, and more particularly to a method for powder coating substrates that optionally can be decorated, for example, by sublimation transfer printing or water transfer printing, and a resultant product.

The history of powder coating began in the late 1940s. At that time, organic polymers were being spray coated in a powder form onto metallic substrates. Then, in 1953, Dr. Erwin Gemmer, a German scientist, developed and patented a fluidized-bed method for the processing of thermosetting powder coatings, which is disclosed, for example, in U.S. Pat. No. 2,844,489. Generally, only functional applications, which required a high film thickness, utilized the fluidized-bed method.

The technology of electrostatic powder coating, developed in the United States, and commercialized between 1962 and 1964, soon overshadowed the fluidized-bed method. Between 1966 and 1973 the four basic types of thermosetting resins—epoxy, epoxy polyester hybrid, polyurethane and polyester, which are still used today, were developed and commercially distributed. In the early 1970s, powder coating spread worldwide, but its growth was modest because application systems were expensive. Additionally, the thickness of powder coated films was generally too great for commercial use, as it consumed significant amounts of materials. Further, color change problems, and high curing temperatures, greatly limited the finished product color spectrum and substrate diversity. For example, softer plastics were difficult to powder coat as the temperatures used to set the powder coat often was great enough to deform or melt the plastics.

Since the early 1980s, powder coatings have seen continuous growth, driven by innovations pertaining to the available materials, improved formulating expertise, advances in application technology, and the development of new applications. There remain, however, opportunities to advance powder coating technology.

SUMMARY OF THE INVENTION

A method is provided for surface treating a substrate utilizing powder coating so that the substrate can be decorated with a durable finish to produce a resultant surface treated product.

In one embodiment, the method can be used to decorate and/or coat substrates as diverse as metal, composites, plastics and wood, and can provide a durable, thin coating that optionally retains sharpness of detail in appearance, where included, and close tolerances for surfaces adjoining mating parts.

In another embodiment, the method can utilize certain materials, equipment and parameters to provide a number of decorative patterns and coating thicknesses. The steps in the method can be augmented or otherwise altered to produce a substrate that is easily decorated by sublimation transfer printing, water transfer printing, or other methods.

In yet another embodiment, the method can provide a visually perceivable transition on a part between a decorative pattern (such as a camouflage pattern or finish) and a first color, or vice versa, that is gradual so as not to display an abrupt line of demarcation. Optionally, the decorative pattern fades into the first color or vice versa. Further optionally, the first color can be a generally solid color.

In still another embodiment, a method is provided for powder coating substrates in at least two contiguous solid colors. A transition between the contiguous solid colors can be gradual so as not to display an abrupt line of demarcation. Optionally, solid color region fades into another adjacent color region.

The embodiments herein can be used to alter the appearance of a variety of products. As an example, the embodiments herein can be used on hunting and shooting sports products, such as archery bows, firearms, and related accessories, where it may be beneficial to blend the products into surroundings to avoid detection. Of course, the embodiments herein also can be used on products outside the sporting goods industry, for example, on military, law enforcement and other products where concealment or other aesthetics are an issue.

These and other objects, advantages, and features of the invention will be more fully understood and appreciated by reference to the description of the current embodiments and the drawings.

DETAILED DESCRIPTION OF THE CURRENT EMBODIMENTS

I. Current Embodiments

Figure 1:
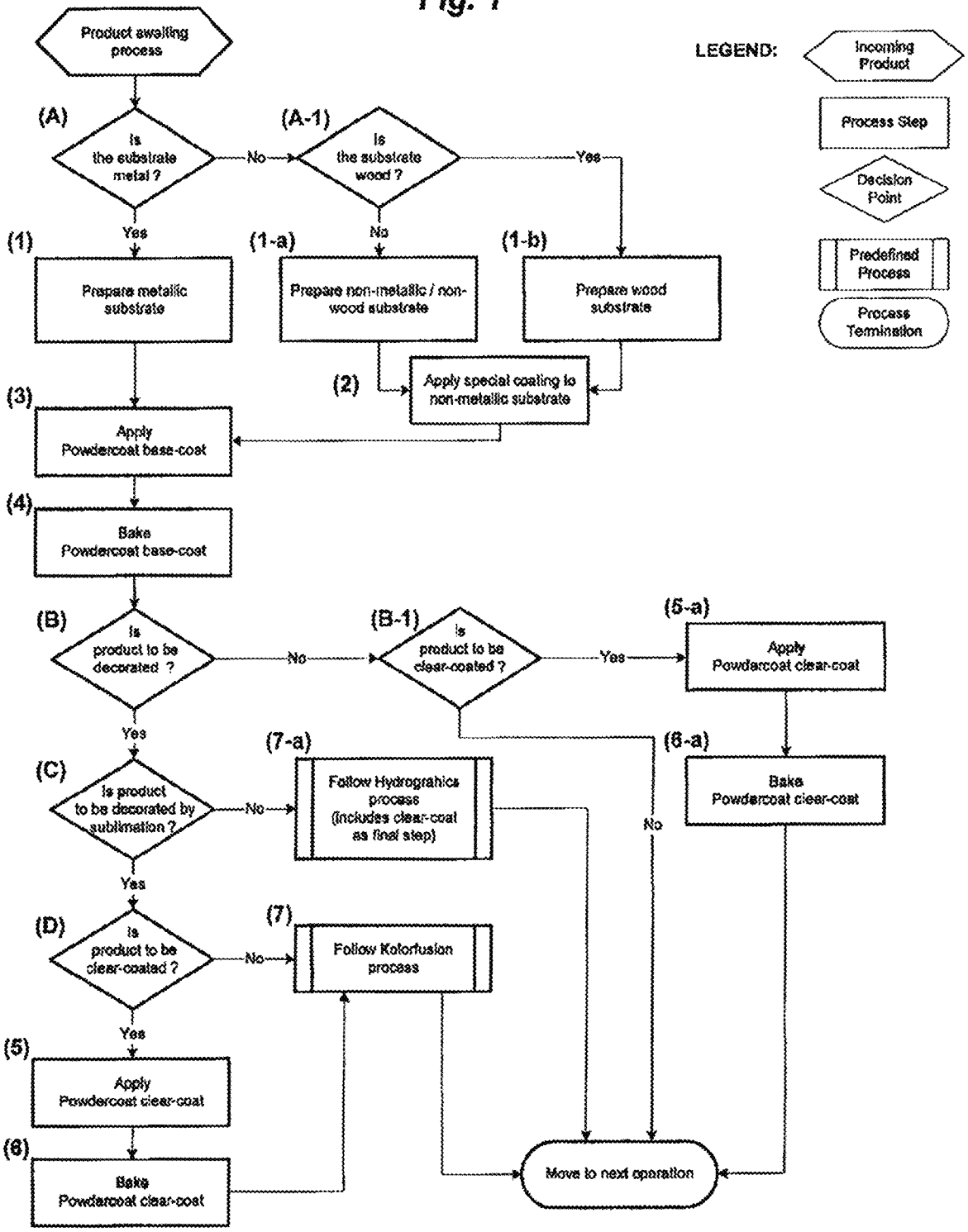
FIG. 1 is a flow chart illustrating a variety of methods of the current embodiments.

Methods of the current embodiments are generally illustrated in the flow charts of FIGS. 1-5, 8 and 10. These methods are versatile so that they can be implemented in many different ways. For example, referring to FIG. 1, the decision points (A) and (A-1) produce three aspects of the current embodiment for treating substrates of different materials, for example, materials that are metallic, materials that are non-metallic/non-wood, and materials that are wood. Other aspects can be derived from these three aspects, and can be further subdivided based on subsequent processing steps as illustrated in FIGS. 1-5, 8 and 10.

For reference, in the flow charts of the figures, the numbers in parentheses, e.g., (1), (1*a*), (1*b*) correspond to steps in the method of the respective flow chart. The letters in parenthesis, e.g., (A), (A-1), (B-1) in the various flow charts correspond to optional decision points in the method of the respective flow chart. Further, although the flow charts illustrate decision points, some or all of those decision points can be eliminated, depending on the application. As an example, if a part to be treated is metal, it is to be decorated by sublimation and it is to be clear coated, then decisions (A), (B), (C) and (D) in FIG. 1 can be skipped, with the part simply undergoing the respective steps (1) and (3)-(7). As another example, if the part is plastic, is to be decorated by the hydrographic method (described below), then decisions (A), (A-1), (B) and (C) can be skipped, with the part simply undergoing steps (1-*a*), (2), (3), (4) and (7-*a*). A variety of other sequences of steps, with or without respective decision points, can be followed depending on the application.

Although described in connection with archery products, the embodiments herein can be used to surface treat a variety of other products, including but not limited to firearm products, other sporting goods products, military products, law enforcement products, automotive products, photographic products, consumer products, construction products, industrial and agricultural products, aeronautical products and the like.

As used herein, a product refers to a complete, assembled article, an assembly of an article, and/or any element, part, piece, component and/or substructure of an article.

As used herein, an archery product includes, but is not limited to, a bow, a bow riser, a bow limb, a bow cam, a bow pulley, a cam system, a limb pocket, a rest, a sight, a quiver, a stabilizer, an arrow, a broadhead, a field point, a release, a bolt, a stock, a forearm, or any other accessory or piece of equipment that might be used in archery or bow hunting. The foregoing archery products can be constructed from a variety of materials including but not limited to aluminum, magnesium, steel, other metals, polymers, composites, fiberglass, natural or synthetic rubber, and/or wood.

As used herein, a firearm product includes, but is not limited to, a firearm, a barrel, a bolt, a slide, a frame, a receiver, a stock, a forearm, a bipod, an accessory rail, a sight, a scope, a magazine, a grip, and a handle, or any other accessory or piece of equipment that might be used in shooting sports or gun hunting. The foregoing firearm products can be constructed from a variety of materials including but not limited to aluminum, magnesium, steel, other metals, polymers, composites, fiberglass, natural or synthetic rubber, and/or wood.

A. Substrate Determination

In the method shown in FIG. 1, a beginning step can be the determination of the substrate material to assist in substrate preparation, particularly where an electrostatic powder coat application is used to powder coat the substrate. In such an electrostatic method, which is detailed generally in U.S. Pat. No. 5,399,198 to Ghaisas and U.S. Pat. No. 5,131,350 to Buschor, both of which are incorporated by reference in their entirety, the substrate, or at least a coating over it, conducts electricity to deposit the powder coat. Referring specifically to the flow chart of FIG. 1, the decision point (A) provides for the determination of the composition of the substrate to which the powder coat is to be applied. If appropriate, the determination by a skilled worker may be performed by a visual inspection of the material from which the substrate is constructed. Where questionable, the substrate can be tested with magnetic or electrical testing devices (e.g., magnets or voltmeters) to determine the conductivity of the material.

In many cases, the substrate can be a portion of, or can form, a three dimensional product. Typically, multiple surfaces of the three dimensional product can be surface treated with the methods herein. Of course, if desired, the substrate can be in a generally two dimensional form, such as a flat planar surface of a sheet of material. Optionally, the surface treatment described herein can be applied solely to that flat, planar surface.

Based on the inspection, the substrate can be generally classified as metallic, non-metallic/non-wood, or wood. For metallic substrates, the method is relatively straightforward, but this is not the case for those that are non-metallic. For example, additional method steps as presented later are used to provide the conductivity for electrostatic powder coating. A surprising feature of the current embodiment is its ability to work with a nearly unlimited diversity of non-metallic substrates as well as metallic substrates. Incidentally, where a part will always be constructed from a specific substrate, the determination can be eliminated from the method.

B. Substrate Preparation

With the substrate material determined in steps (A) and (A-1), the product is prepared, depending on the substrate as noted in steps (1), (1*a*) and (1*b*) of FIG. 1. The extent of the preparation depends on the condition of the substrate to be powder coated, as well as the material from which the substrate is made. With regard to the condition, in many cases, it can be suitable to remove all or at least a substantial part of any contamination that exists either in the form of residual surface contamination, burrs or other surface aberrations from a prior operation, such as milling or grinding the substrate. In some cases, the surface condition of the part to be powder coated can affect the uniformity of the coating. For example, surface anomalies, such as burrs, can affect the flow of the material resulting in build-up of material on the burr and/or voids in adjacent areas. In general, the preparation is commensurate with the size and shape of the parts, and the location and extent of the burrs or other surface aberrations where present.

Where washing and rinsing of the substrate will suffice for the preparation, a detergent can be used on the substrate. The substrate washing may be performed via immersion with agitation, or scrubbing. Steam cleaning the substrate is another viable option.

The presence of burrs from a prior machining operation or flash from molding can cause issues in the application and final appearance of the powder coat. Thus, the burrs or other surface aberrations can be removed. Removal can be accomplished by a variety of techniques, such as either media blasting or tumbling depending on the shape and size of the part.

Tumbling works well on small symmetrical parts. Removal of burrs or flash from large and/or more complex parts can be accomplished in a media blasting cabinet where the direction and timing of the blasting is under the control of the operator. The type, size and shape of the media used can be based on the part configuration and/or the size and location of the burrs, flash or surface aberration. A variety of media, such as glass beads, smooth or sharp aggregate, and other materials can be used in tumbling. The size of the media can range from 60 to 120 microns.

C. Non-Metallic Substrates

As mentioned above, where electrostatic powder coating is utilized, non-metallic/non-wood substrates, e.g. plastics, composites, ceramics, glass and the like, and wood substrates are further prepared with a special coating in step (2) as shown in FIG. 1. Generally, the special coating is used where the substrate is non-metallic or non-conductive. One example of the special coating is an electrically conductive primer. A variety of coatings to make the substrate compatible with the electrostatic powder coating method such as an iodine solution and/or a primer containing metallic or graphite particles may provide a satisfactory electrically conductive coating on non-metallic substrate. One suitable commercial product is a VOC-free water based, clear liquid preparation designed to promote conductivity over non-metallic substrates, which is available from Dow Chemical of Reading, Pa. It is primarily ionized water, also known as dihydrogen oxide or diprotium oxide. The coating may be applied to the substrate by atomization or immersion, depending on the configuration of the part being coated. Examples of suitable coating methods are found in U.S. Pat. No. 5,962,368, which is hereby incorporated by reference. In the coating method, all the surfaces to be powder coated later are coated with the special coating, for example, the electrically conductive coating. Optionally, a blow-off step can be employed to remove drips and speed drying time before powder coating and/or after the special coating is applied.

Where the substrate is wood, the conductive coating can also be employed, however, additional preparation can be performed. For example, to reduce the existing moisture content of the wood, a baking cycle can be utilized. Suitable baking temperatures are optionally 300° F. to 450° F., further optionally 350° F. to 400° F., and even further optionally 375° F. The length of the baking cycle can be determined by the initial moisture content, but can vary from 10 to 30 minutes, optionally 15 to 25 minutes, and further optionally 18 to 22 minutes, or other durations as desired.

After reducing the moisture content of a wood substrate to a satisfactory level, the wood optionally is allowed to cool before applying an initial coat of the conductive material, such as "Mor-Prep", which is commercially available from Rohm and Haas Chemicals, LLC of Philadelphia, Pa. Sometimes, because of the permeable nature of the substrate and low viscosity of the conductive material, the conductive material is applied to provide complete and uniform coverage of the surfaces to be powder coated. Pooling of the special coating, for example, the conductive material, on the surface to be powder coated is avoided to reduce non-uniform subsequent coating. The initial coating can be baked on the wood substrate for a period of about 15 minutes at 375° F., optionally 20 minutes at 300° F., and further optionally 10 minutes at 400° F. After the initial coating cools, a second coat of the special coating can be applied and allowed to air dry, or dried with heat or by passing moving air across the part.

D. Powder Coat Base Coat Application and Baking

With the substrate adequately prepared, based on the material from which it is constructed, the method can proceed to steps (3) and (4) in which powder coat base coat is applied and baked onto the substrate or the conductive coating where employed. After steps (3) and (4) in the method, a very thin but durable coating is achieved that can ensure a successful subsequent, optional, decorative procedure, such as transfer printing. The thinner base coat can enable the decorative pattern to be transferred with minimal distortion, and without obscuring minute details on the part or product. Optionally, for those applications where the base coat is to be followed by a clear coat, the base coat thickness can be about 0.5 mils to about 3.0 mils, further optionally about 1.0 mils to about 2.5 mils, and even further optionally about 1.0 mils to about 2.0 mils.

Referring to decision points (B) and (B-1) of FIG. 1, for those products where the base or color coat layer is the final finish (i.e., no clear coat layer after decision point (B-1)), the surface treatment film thickness range can be about 2.0 mils to about 4.0 mils for increased durability. On product where aesthetics or appearance is paramount, a thinner coating, for example about 1.0 mils to about 3.0 mils, can enable the retention of original detail not possible with the heavier coatings normally associated with powder coating. On products where dimensional tolerances are diminutive, particularly mating surfaces, (such as sliding dovetails) the current embodiments achieve the desired closeness of fit not previously realized. Of course, other thicknesses of the surface treatment can vary for other applications.

Precise control of the application of the powder coat base coat layer in step (3) can achieve the beneficial results described above. Such control can be achieved by using specialized equipment for the electrostatic deposition of the powder coat material for the base coat layer. To achieve a high degree of control, the equipment for the application method can be designed to function as a unit, and operate as an integrated system. For example, the booth, containing the draw units and electrically charged hooks, the hopper for the raw material, and the spray guns used in the electrostatic powder coating method can be from a single manufacturer so that they all work together. An example of an integrated system includes a booth, a hopper, and a powder coat gun. The powder in the hopper is under continual agitation to maintain uniformity of the material supplied to the gun. The pattern of dispersion of the electrically charged powder from the gun can be controlled to suit the size and shape of the part be sprayed. Further dispersion control of the material can be achieved by moving the gun in a circular motion. The electrostatic charge applied to the substrate is controlled by a pulsating power source that allows for the deposition of a thin film of powder. The output pulse voltage has a high and a low value. The high value can range from 50 to 150 KV and the low value can range 0 to 50 KV. The pulse width and pulse interval can range from several milliseconds to several hundred milliseconds.

In the powder coating apparatus, the low voltage pulse signal is generated by a pulse signal generation circuit. The low voltage is boosted to a high voltage by means of a high voltage impression circuit, so that it is impressed upon corona electrodes located in the gun. As a result, a corona discharge is intermittently generated from the corona electrodes toward the object to be coated. Accordingly, powder coating material sprayed from the gun nozzle is charged with negative ions developed by the corona discharge. The powder coating material is directed toward the object to be coated and deposited on a surface of the object as a layer or coating. A suitable powder coating apparatus and method for electrostatically coating an electrically grounded object using a pulse system is disclosed in U.S. Pat. No. 7,238,394, to Morita et al., which is hereby incorporated by reference in its entirety. That apparatus and method are similar to that employed by the integrated equipment noted above.

After satisfactory application of the powder coat, the parts including the powder coated substrates can be placed on racks that are placed in a baking oven (4). The temperature of the oven is thermostatically controlled to a target value, optionally 365° F. to 385° F., further optionally 370° F. to 380° F., and even further optionally 375° F. The length of time in the bake cycle can be a function of part size and complexity of the surface features of the part, and can vary from 10 to 30 minutes, optionally 15 to 25 minutes, and further optionally 18 to 22 minutes.

After adequate baking on of the powder coat base coat in step (4) in FIG. 1, the racks with the powder coated parts optionally can be removed from the oven, placed in a cooling area and allowed to cool before further methoding.

E. Powder Coat Base Coat Material

The materials used for the base coat and/or color coat of steps (3) and (4) can be polyester, epoxy, TGIC and/or polyurethane, or other suitable powder coating materials. The base coat layer and/or color coat layer can range across the color and hues spectrum as well. For example, in addition to black, white and gray, a wide spectrum of hues and shades of color are conceivable for the base and/or color coat.

A similar selection is available for the degree of gloss of the finished base and/or color coat, ranging from flat to a high gloss. The degree of gloss can be enhanced by the application of a clear coat, which can be useful for those products that are not to be decorated, for example, products that are further processed via method steps (5*a*) and (6*a*) in FIG. 1.

If the end product is not to be decorated, indicated by "No" after decision point (B) in FIG. 1, then the color selection is virtually unlimited for the base coat/color coat in steps (3) and (4). However, if the product is to be decorated with a decorative pattern after decision point (B) in FIG. 1, for example, by sublimation transfer printing (7), then the base coat color layer applied in step (3) is selected with care so that underlying color is compatible with the colors in the transferred decorative pattern, and so that the base coat color does not overwhelm the transferred decorative pattern or significantly obscure details of the transferred decorative pattern. As an example, where the transferred decorative pattern is that of a camouflage coloration having various shades of brown and green, a suitable base coat applied in steps (3) and (4) may be off-white, optionally light gray or further optionally pale tan.

If the product is to be decorated after decision (B) in FIG. 1, by water transfer printing, for example, in step (7-*a*), then the base coat color in steps (3) and (4) is selected to be compatible color wise with the transferred decorative pattern; however, it also is selected so that it will be compatible with the product material and accept the inks of the printed decorative pattern. Any material with a non-porous surface generally is suitable for water transfer printing including but not limited to rubber, metal, wood and plastic. Generally, base coats for water transfer printing can be waterborne or solvent-borne, some examples being lacquers, polyurethanes, or material suitable for powder coating.

F. Powder Coat Clear Coat Application and Baking

Referring again to the flow chart of FIG. 1, the steps in the method (5) and (6), alternatively (5*a*) and (6*a*), include the application and baking of the powder coat clear coat layer at least partially on or over the substrate, the special coating, and/or the base coat if previously applied to the part. Steps (5) and (6) apply to an aspect represented by products that are to be decorated by sublimation transfer printing in step (7), also referred to as the "Kolorfusion" method as described below. Steps (5*a*) and (6*a*) apply to an aspect previously described, where the parts or products have been coated in steps (3) and (4) and are to receive only a clear coat for increased gloss and/or durability. Typically, in the latter aspect, those parts are coated with a base coat that is aesthetically pleasing, for example, it may be of a solid color, or of a designed combination of colors or of a pattern.

The powder coat clear coat layer application in step (5) and baking step (6) can follow the same procedures and utilize the same equipment as that described for the application step (3) and baking step (4) for the base coat or color coat, noted above. Further, the thickness of the clear coat, also referred to as the film thickness or simply the thickness herein, can depend on its intended function. For example, the clear coat noted above may serve as: a final coat over a color coat (refer to steps (5*a*) and (6*a*) in FIG. 1); an interface for transfer printing by sublimation (refer to steps (5), (6), and (7) in FIG. 1); and/or as the final coat in water transfer printing (refer to step (7*a*) in FIG. 1, which can include a clear coat application and baking, like those described above, over the decorative pattern deposited in the hydrographic method). The clear coat may range optionally between about 0.5 and about 5.0 mils, further optionally between about 1.0 and about 3.0 mils, and even further optionally between about 1.5 and about 2.5 mils.

G. Powder Coat Clear Coat Material

If the product is not to be decorated, but will include a clear coat (refer to steps (5*a*) and (6*a*) in FIG. 1.), a broad selection of materials may be used. In these applications, the clear coat may serve the function of enhancing the gloss or the durability of the color coat or a combination of both. The intended function of the clear coat can dictate the material to be used. The clear coat application (5-*a*) and baking methods (6-*a*) can follow the same procedures and utilize the same equipment as that described for the application (3) and baking (4) methods for the base coat, noted above. The clear coat may range in thickness, optionally between about 0.5 and about 5.0 mils, further optionally between about 1.0 and about 3.0 mils, and even further optionally between about 1.5 and about 2.5 mils.

H. Decorative Pattern

As used herein, a decorative pattern, also referred to herein as a decorative finish or a decoration, is a pre-constructed image or pattern, created with surface treatments, inks, paints, coatings and/or other materials, that when applied to a surface of an article provides a non-homogeneous appearance with visually noticeable variations across the image or pattern, unlike a solid color, as that term is defined below. Examples of such decorative patterns include, but are not limited to: camouflage patterns, whether artistic, digital and/or image based; checker board patterns; paisley patterns; tye-dyed patterns; images of objects, people, animals, or other things; artistic works, and the like. Suitable camouflage patterns can be patterns commercially available from any camouflage pattern designer, and can be fixed on a film or other sheet or material until it is applied to a product. Further, although it includes the term "pattern," a decorative pattern need not include a repeated decorative design or element.

For those substrates properly treated with one or more powder coat layers, and intended to be decorated with a desired decorative pattern, a variety of methods can be used to join that decorative pattern with the intended part. Two optional decoration methods utilize "transfer printing," which generally includes transferring a decorative pattern, which can be in the form of a film or layer or other construction, to a substrate. One transfer printing technique is water transfer printing, also referred to as a "hydrographic method." Another transfer printing technique is a "sublimation method." Certain types of hydrographic methods or water transfer printing are explained in U.S. Pat. No. 6,935,230 to Walker et al and U.S. Pat. No. 6,953,511 to Bowles, Jr. et al, which are hereby incorporated by reference in their entirety. One type of sublimation method, known as the "Kolorfusion method" is explained in several U.S. Pat. Nos. 5,962,368; 5,893,964; 5,798,017 and 5,308,426 which are hereby incorporated by reference in their entirety.

In general, the hydrographic method, also referred to as water transfer or immersion printing, is a method in which a thin film including the desired decorative pattern is floated on water or some other compatible liquid. The film optionally is sprayed with a chemical activator to promote the transfer of the decorative pattern, for example, an image to a product. The product to be decorated is immersed in the film floating on the water, with the film wrapping around the product as it is immersed, thereby joining the film and thus the decorative pattern with the product. Optionally, the decorative pattern forms a layer on the product or whatever substrate to which it is joined.

In the methods of the embodiments herein, the substrate to which the thin film joins can be the powder coat base coat layer applied to the product, for example in FIG. 1, that is applied in steps 3 and 4, or in some very limited circumstances, where no base coat layer is applied, the substrate can be metal or other material. An optional powder clear coat layer, as described above, can be applied after the water transfer printing for enhanced durability. This clear coat layer can be applied and baked over the water transfer printed decorative pattern using the application and baking techniques described above in connection with steps (3) and (4).

In general, decoration by sublimation is a method in which inks, dyes or other materials, which constitute a decorative pattern and which are located on a first sheet, are heated to the point of vaporization, optionally under vacuum, and transferred from the first sheet to a suitable adjacent substrate, which is optionally coated with a material. In this transfer, the decorative pattern can become part of the substrate to which it is transferred, in some cases becoming impregnated in and/or on the substrate. Optionally, the decorative pattern transfers onto and/or into the substrate, and generally forms a layer on and/or at least partially in the substrate or whatever product to which it is transfer printed by sublimation. A well known sublimation method is typically identified by the trade name "Kolorfusion", which is owned by Kolorfusion International of Aurora, Colo.

In the present embodiment, the transfer printing of the decorative pattern relative to the substrate can occur after the color coat layer and clear coat layer are applied in steps (3),(4) and (5),(6). Optionally, the powder clear coat layer or the surface of the product itself can be the substrate that directly accepts the inks, dyes or other materials of the decorative pattern in the transfer printing technique used.

Products decorated by the water transfer printing method, referring to step (7*a*) in FIG. 1, can use materials that are compatible with the inks of the printing method and the temperatures of the curing method. Further, a clear coat layer can be applied after the transfer printing step in the hydrographics method, noted in step (7*a*), in which case, the clear coat can become the surface exposed to the elements and can function to increase durability of the finish. As described in U.S. Pat. Nos. 6,935,230 and 6,953,511, which are hereby incorporated by reference, the basic steps of one suitable hydrographic method or water transfer printing method are: surface preparation; base coat application; image film orientation; film activation; immersion; rinsing and drying; and clear coat application. Supplementary steps may include scuffing of the surface to be decorated and the use of an adhesion promoter/primer prior to application of the base coat. Buffing of the clear coat after curing and drying also may be included.

For parts decorated with the sublimation printing method, the clear coat can be applied before the sublimation step (refer to steps (5), (6), and (7) in FIG. 1). There, the clear coat can serve as the interface or substrate for the transfer of the inks or other materials that form the decorative pattern. The clear coat material can be compatible with and can be able to accept the inks of the printed decoration. A suitable material is an acrylic-based particle or powder coat, which is commercially available from PPG Industries of Pittsburgh, Pa.

Alternatively, for product decorated by the sublimation method, indicated by "yes" after step C in FIG. 1, the base coat applied in steps (3) and (4) may be utilized as the substrate for the transfer printing, referring to decision point D in FIG. 1, omitting the clear coat step. The base coat can be any coating that bonds well with the substrate, and that is of a suitable light color which does not overwhelm a decorative pattern over the base coat, such as the examples of base coats provided below.

Figure 2:
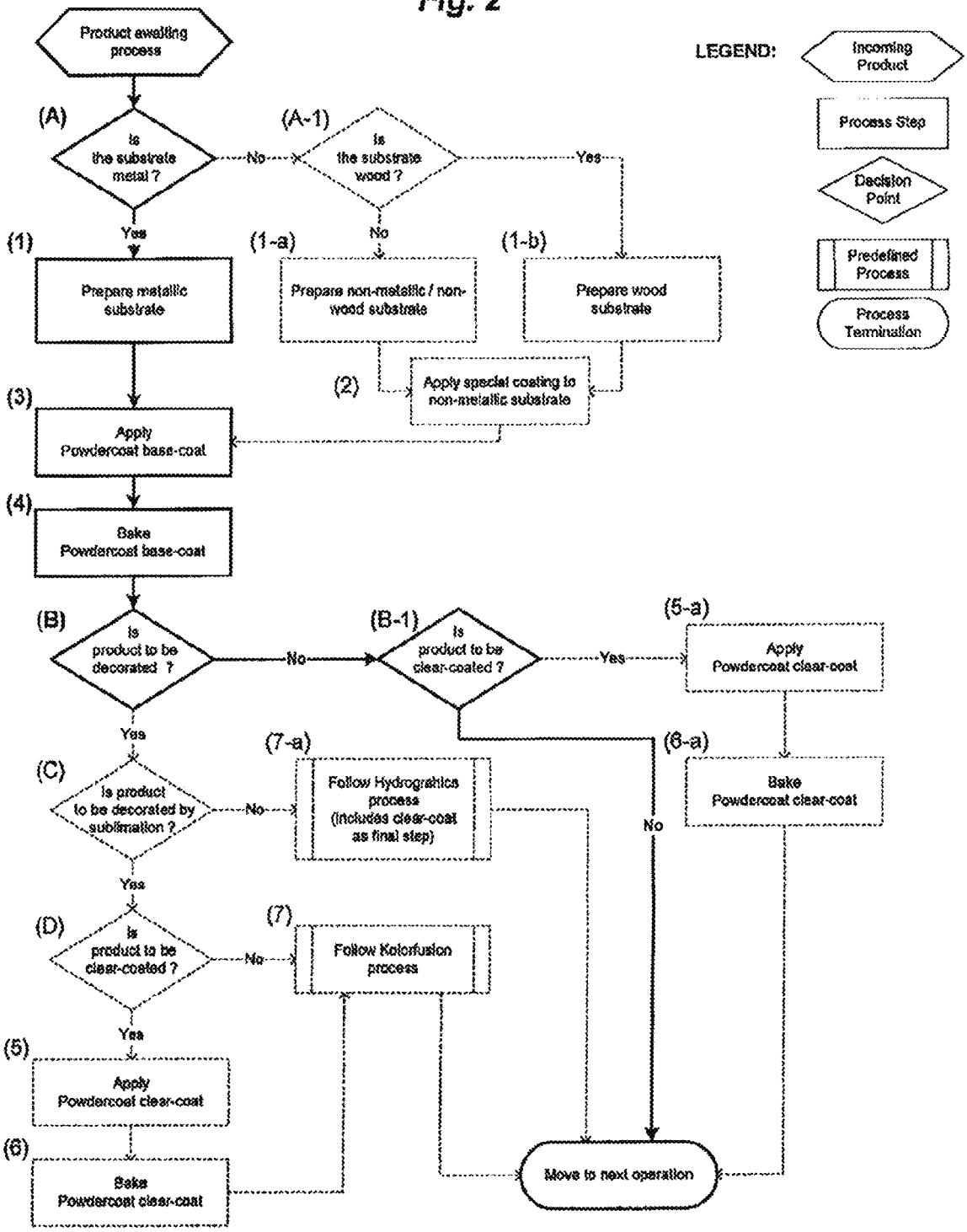
FIG. 2 is a flow chart illustrating a first aspect of the methods of the current embodiments.
Figure 3:
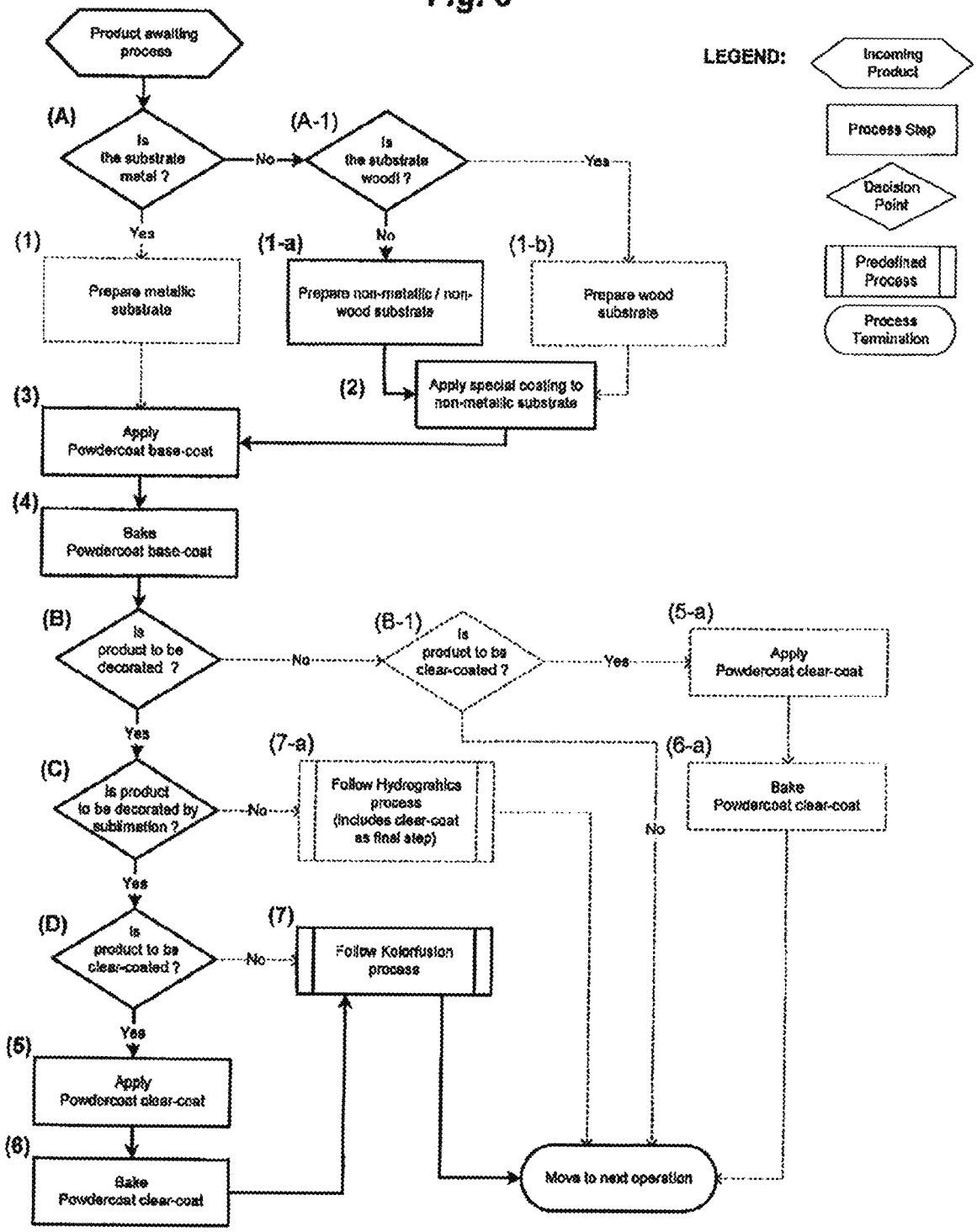
FIG. 3 is a flow chart illustrating a second aspect of the methods of the current embodiments.

Two other exemplary aspects are illustrated in FIGS. 2 and 3. In FIG. 2, a relatively "simple" embodiment is illustrated, where the base coat is applied in step (3) to a metallic substrate prepared in step (1) and baked in step (4). In this embodiment, the base coat application in step (3) and its subsequent baking operation in step (4) are the last steps in the powder coat method. In this embodiment, the base coat can be accurately described as the color coat since it is the color and finish of the final product. Yet another embodiment can result from the application in step (5*a*) and baking in step (6*a*) of a clear coat to or over the color coat.

In the aspect of the method illustrated in FIG. 3, the final product can be decorated by a sublimation transfer printing method identified as step (7) (refer to decision points (B), (C) and (D) of FIG. 3). As shown, this method may include the application in step (5) and baking in step (6) of the clear coat over the base coat in steps (3) and (4). Optionally, as another embodiment, the sublimation printing may be applied directly to a base coat of a suitable material.

An alternative to the sublimation printing method, e.g. the Kolorfusion process is the hydrographic or water transfer printing described above, which provides yet another aspect. In this aspect, a clear coat can be applied following the decorative pattern transfer, usually in a liquid form.

I. Examples

The following are examples of the embodiments and aspects described above being implemented. These examples are provided for illustrative purposes only, and are not intended to limit the above embodiments and aspects.

1. Example 1

In this example, an aluminum compound bow riser is powder coated, as illustrated through step (B) in FIG. 2. The powder coated aluminum riser may thereafter be processed as desired.

After machining the riser, step (1) follows. Because the riser is aluminum (metal), the riser is prepared as follows; the riser and related parts are placed in a washer, washed in Krud Kutter/Hot Water solution for 2-3 minutes, and removed. Screws are inserted in threaded holes defined by the riser to protect the threads. The riser is then media blasted in a hand sand blaster using white silica until matte finish is achieved.

With the riser prepared, the method proceeds to steps (3) and (4). There, a powder coat color coat is applied to the riser. To do so, the air pressure at the powder coat station is adjusted to 0.75 pounds per square inch. The hopper is loaded with the proper powder. The operator starts the hopper, and checks for agitation motion of powder in hopper. The operator switches on powder coat station draw units, and places the risers on electrically charged hooks. The operator sprays the riser with a circular motion of the powder coat gun until the riser is fully covered. The operator removes the riser from the hook and places it in a rack. With the application of the base coat completed in step (3), the riser is baked in step (4). To do so, the rack including the riser is placed in an oven pre-heated to specified temperature, for example, 380° F. The riser is baked at a specified temperature, for example, 380° F. for a specified time, for example, 18 minutes. Thereafter, the rack including the riser is removed from the oven and placed in a cooling area. The operator removes the cooled riser from the rack, inspects them, and moves the riser to the next desired operation.

2. Example 2

In this example, fiberglass composite compound bow limbs are powder coated through step (7) in FIG. 3. The method begins after machining the limbs to a desired configuration. Specifically, steps (A), (A1) and (1*a*) are followed. Because the limbs are non-metallic/non-wood, they are prepared by placing 70 pieces/load in a tumbler and tumbled for 2 hours with suitable abrasive media. The limbs are rinsed with hot water and blown dry. The limbs undergo a deflection test and are stamped. In step (2), an electrically conductive coating is applied. To do so, the limbs are sprayed with the electrically conductive coating through a conventional atomizer. The limbs are moved to a powder coat spray booth to apply powder coat base coat while electrically conductive coating is still wet. Referring to step (3), a powder coat base coat, available from PPG Industries of Southfield, Mich. is applied and baked onto the limbs in substantially the same manner as described in Example 1.

Decisions B, C and D are followed, and then cooled parts are removed from the rack, inspected, and moved to powder coat spray booth to apply powder coat clear coat according to steps (5) and (6). Specifically, a powder coat clear coat, e.g. low gloss clear powder coat is applied and baked using substantially the same techniques described above in Example 1 in connection with applying and baking the base coat. The cooled limbs are removed from the rack, inspected, and moved to staging site for the Kolorfusion method of step (7).

In the Kolorfusion method of step (7), the following substeps can be performed. An operator selects a desired pattern of transfer printing fabric with specified pattern reduction (e.g. RealTree AP @ 50%). The operator pre-assembles a plastic bag by attaching air connector and sealing bottom of bag. The operator surrounds each limb with transfer printing fabric and places it in a pre-assembled plastic bag. The operator connects an air connector on the plastic bag through a hose to vacuum source. The vacuum source applies a vacuum (~25" Hg). The operator ensures that all areas of the part are being covered with printing fabric while applying vacuum. The operator can check for vacuum leaks and correct as needed. The operator attaches the bags with the limbs therein to a manifold and repeat steps 10 through 14 until all positions on the manifold are filled. The operator then places the manifold with bagged parts in preheated (e.g. 300° F.) oven for specified time (e.g. 15 minutes) The operator removes the manifold from the oven, and removes bagged parts from manifold. The operator removes wrapped limbs from plastic bags and strips off the transfer fabric. The operator finally inspects the limbs and moves them to the next operation.

II. First Alternative Embodiment

A first alternative embodiment provides a method to produce a gradual transition between any combination of decorative patterns as described above, a first color, and a second color. In one aspect of the method, the method can create on a product a transition between a decorative pattern (such as a camouflage pattern or finish) and a first color, or vice versa, that is gradual so as not to display an abrupt line of demarcation between the decorative pattern and the first color.

Optionally, the first color can be a solid color, which means that when the color is on a surface and viewed by a viewer, the solid color appears to have a generally uniform appearance, without substantial or otherwise noticeable variations in appearance from area to area, like that of a decorative pattern. Of course, a solid color can be any color having virtually any hue, value and saturation. Further, a color can vary somewhat in any one or more of its hue, value and saturation across a surface to which it is applied and still be considered a solid color. Finally, as used herein, a color, whether a solid color or not, can include black or white, and any variations of thereof.

In another aspect, the method provides a way to powder coat substrates in at least two contiguous colors. A transition between the contiguous colors can be gradual so as not to display an abrupt line of demarcation.

In this first alternative embodiment, a transition region or zone can be produced. The length of this transition region can be about 0.5" to about 10.0", optionally about 1.0" to about 8.0", and further optionally about 2.0" to about 6.0". Exemplary transition zones are illustrated in FIGS. 6, 7, 9 and 11-13. The transition region(s) may be located wherever desired, but optionally, they can be located at either or both ends of the product being decorated. The transition region can be of other lengths as desired. Those lengths can be selected so that within the transition region, a viewer V can perceive a first color fading to a decorative finish or another color, or vice versa. Generally, the transition region will not be less than ⅛" to ¼".

Further, in this embodiment, the transition region can be located in various regions of a product, which can be constructed from various elements. In one example, the transition region can be within a single element of the product or part decorated. As a more specific example, the transition region can be located on the riser of an archery bow.

In another example, the transition region can flow between or cross onto at least two different structural elements of the product or parts being decorated. As a more specific example, on a compound archery bow, a transition region can span from the riser, across the limb pockets, and partially onto the limbs of the bow, stopping short of the extreme limb ends.

In yet another example, the transition region can be located between orthogonal surfaces of a structural element. As a more specific example, on an archery bow, the transition region can be between the edges of the riser or limbs, generally parallel to the plane of the bowstring and the surfaces of the riser or limbs, generally perpendicular to the plane of the bowstring.

Implementation of the first alternative embodiment can provide certain aesthetics to a product, and/or can provide functional and practical uses. For example, a single bow manufactured with the method of the first alternative embodiment can be dual-purpose, providing visual characteristics suitable for both blind hunting, where the interior of the blind is dark, and treestand hunting, where the surroundings are natural materials, such as limbs, leaves and other foliage. Such a bow can include a dark solid color on those parts exposed to game through a window of the dark-interior blind. For example, the front of the riser can be a solid color, such as black. That same bow can include parts that have a camouflaged decorative pattern. For example, the limbs, limb pockets and portions of the riser immediately adjacent the limb pockets can have a decorative pattern that is camouflage. Thus, when the bow is used in a treestand, it readily blends with the natural surroundings as well.

The method of the first alternative embodiment also can be used to alter the appearance of other forms of hunting and shooting sports articles, such as firearms, cross bows, and related equipment and accessories, where it may be beneficial to blend the articles into surroundings to avoid detection, and where a uniform, single color or a single decorative pattern may stand out rather than conceal the article. Further applications can be items outside the sporting goods industry, that is, wherever a gradual transition of a decorative pattern to a solid color, a solid color to another solid color, or a single solid color of one shade to the same solid color of another shade is desired for aesthetic or practical applications.

Figure 4:
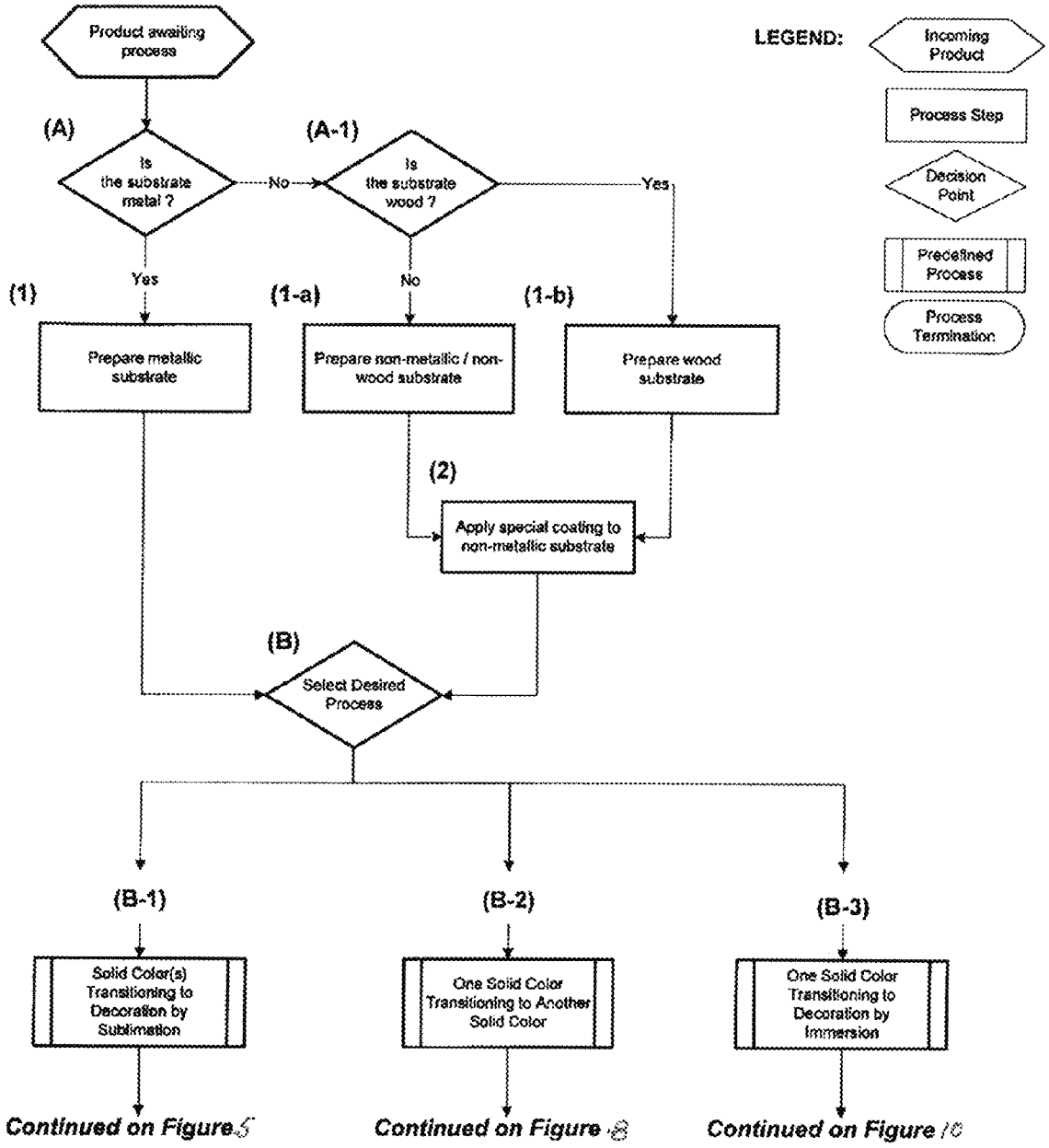
FIG. 4 is a flow chart illustrating a variety of methods of a first alternative embodiment.

Turning to FIG. 4, several aspects of the first alternative embodiment will now be described. Like the embodiment above, the decision points (A) and (A-1) produce three aspects for treating substrates of different materials, for example, materials that are metallic, materials that are non-metallic/non-wood, and materials that are wood. The decision points (B-1), (B-2) and (B-3) provide three more aspects for treating the surfaces of the substrates to produce different transitions or "fades" for the surface treatments that are illustrated in FIGS. 5-7, 8-9 and 10-11. Further, although the flow charts illustrate decision points, some or all of those decision points can be eliminated, depending on the application.

In the method of the first alternative embodiment shown in FIG. 4, the beginning steps include determining the substrate material to assist in substrate preparation, and substrate preparation. These steps, the materials and techniques used therein can be similar to those of the current embodiment described above and shown in FIG. 1.

With the substrate adequately prepared and/or specially coated, as described above in connection with the current embodiment, the method proceeds to the decision point (B) in FIG. 4. At this point, a determination can be made as to which aspect of the method is to be utilized. Aspect (B-1) can produce a product including a first color, such as a solid color, that transitions to a decorative pattern via a sublimation method. Aspect (B-2) can produce a product including a first color, which can be a solid color transitioning to one or more other second colors, such as a solid color, or another shade of the same first color. Aspect (B-3) can produce a product including a first color, such as a solid color, that transitions to a decorative pattern via a hydrographic method. Of course, if it is known that a certain aspect of the method is to be followed, the step of making the determination in (B) can be skipped, and the method can continue.

Figure 5:
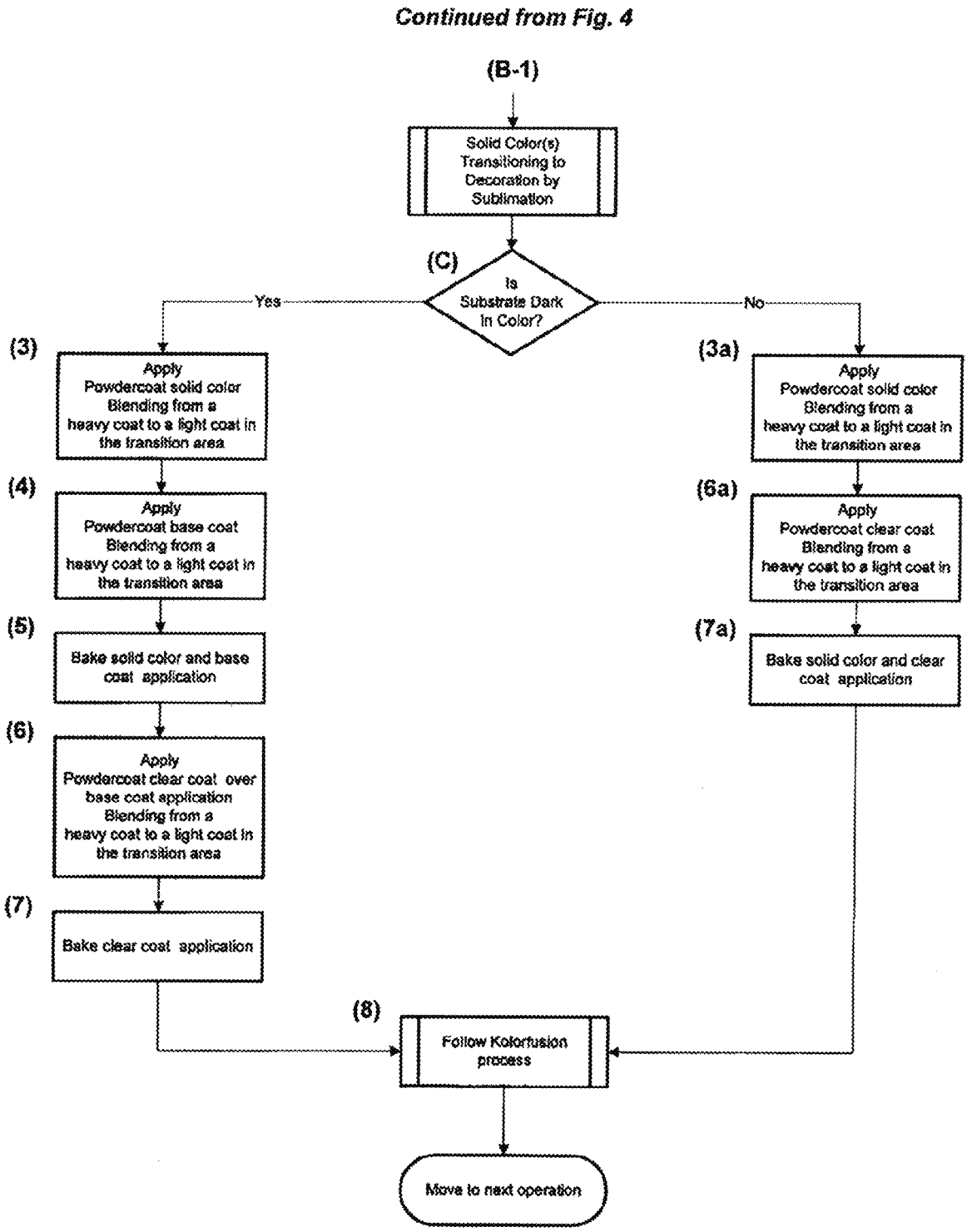
FIG. 5 is a continuation of the flow chart of FIG. 4 illustrating an aspect of the first alternative embodiment that can produce a product that includes a color transitioning to a decorative pattern produced using sublimation.
Figure 8:
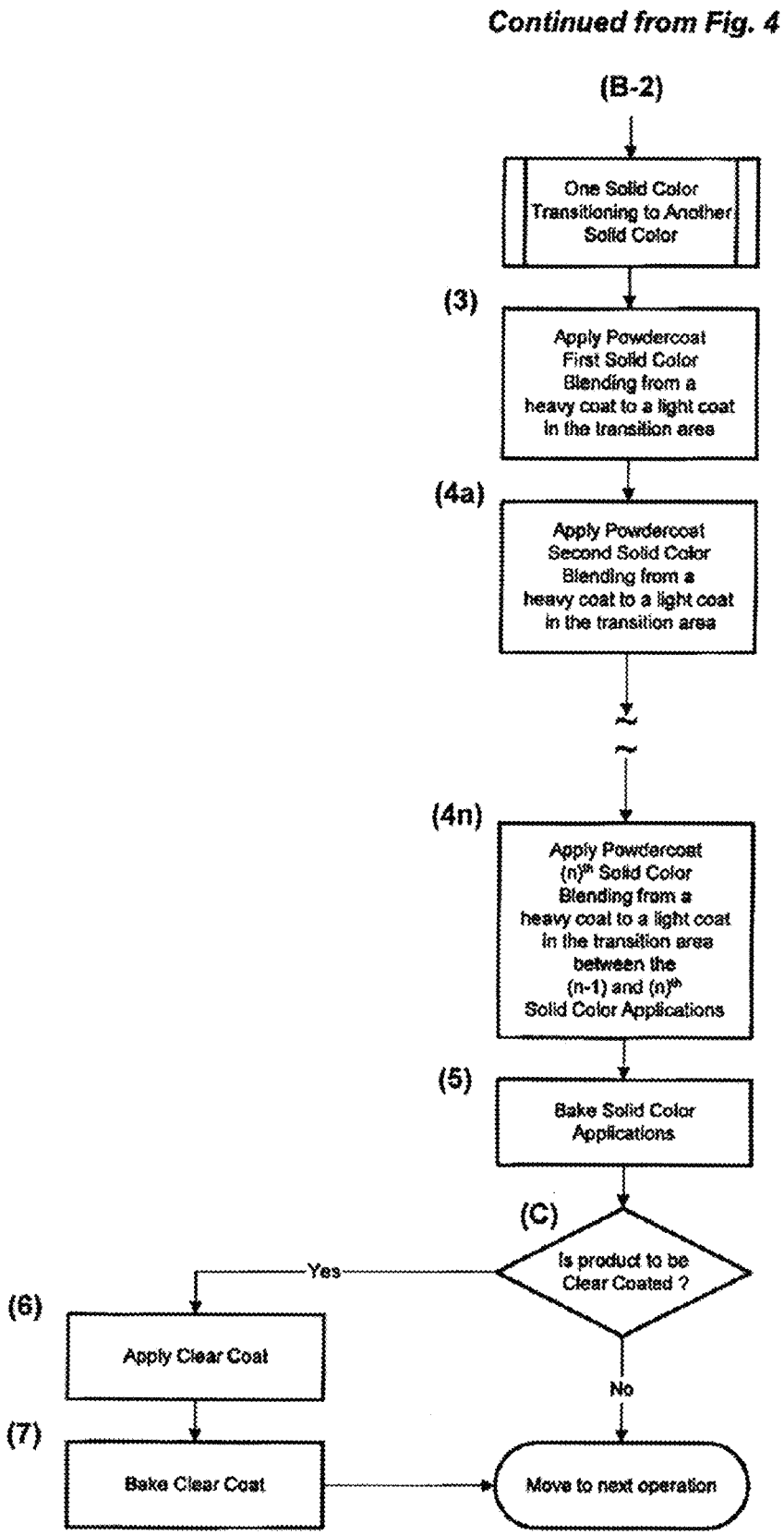
FIG. 8 is a continuation of the flow chart of FIG. 4 illustrating an aspect of the first alternative embodiment that can produce a product that includes a first color transitioning to another second color.
Figure 10:
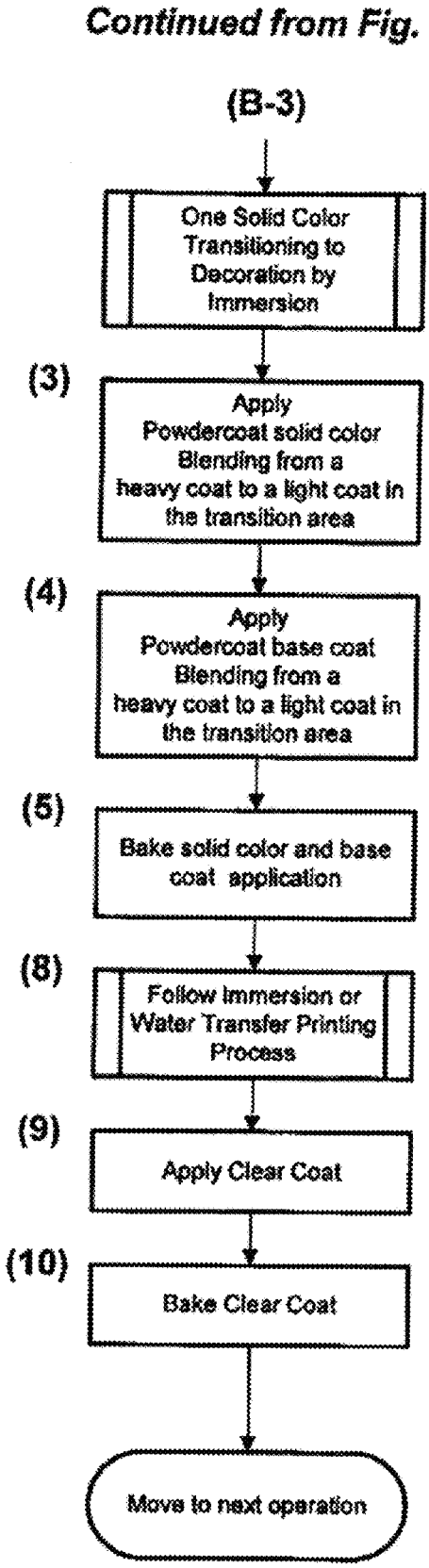
FIG. 10 is a continuation of the flow chart of FIG. 4 illustrating an aspect of the first alternative embodiment that can produce a product that includes a solid color transitioning to a decorative pattern produced using a water transfer printing method.

The steps of aspect (B-1) are illustrated in FIG. 5, which is a continuation of the flow chart in FIG. 4. Generally, these steps can produce a solid color transitioning to a decorative pattern via a sublimation method. The steps of aspect (B-2) are illustrated in FIG. 8, which is a continuation of the flow chart in FIG. 4. Generally, these steps can produce a solid color transitioning to another solid color or another shade of the same color. The steps of aspect (B-3) are illustrated in FIG. 10, which is a continuation of the flow chart in FIG. 4. Generally, these steps can produce a solid color transitioning to a decorative pattern via an immersion method or water transfer printing.

Figure 6:
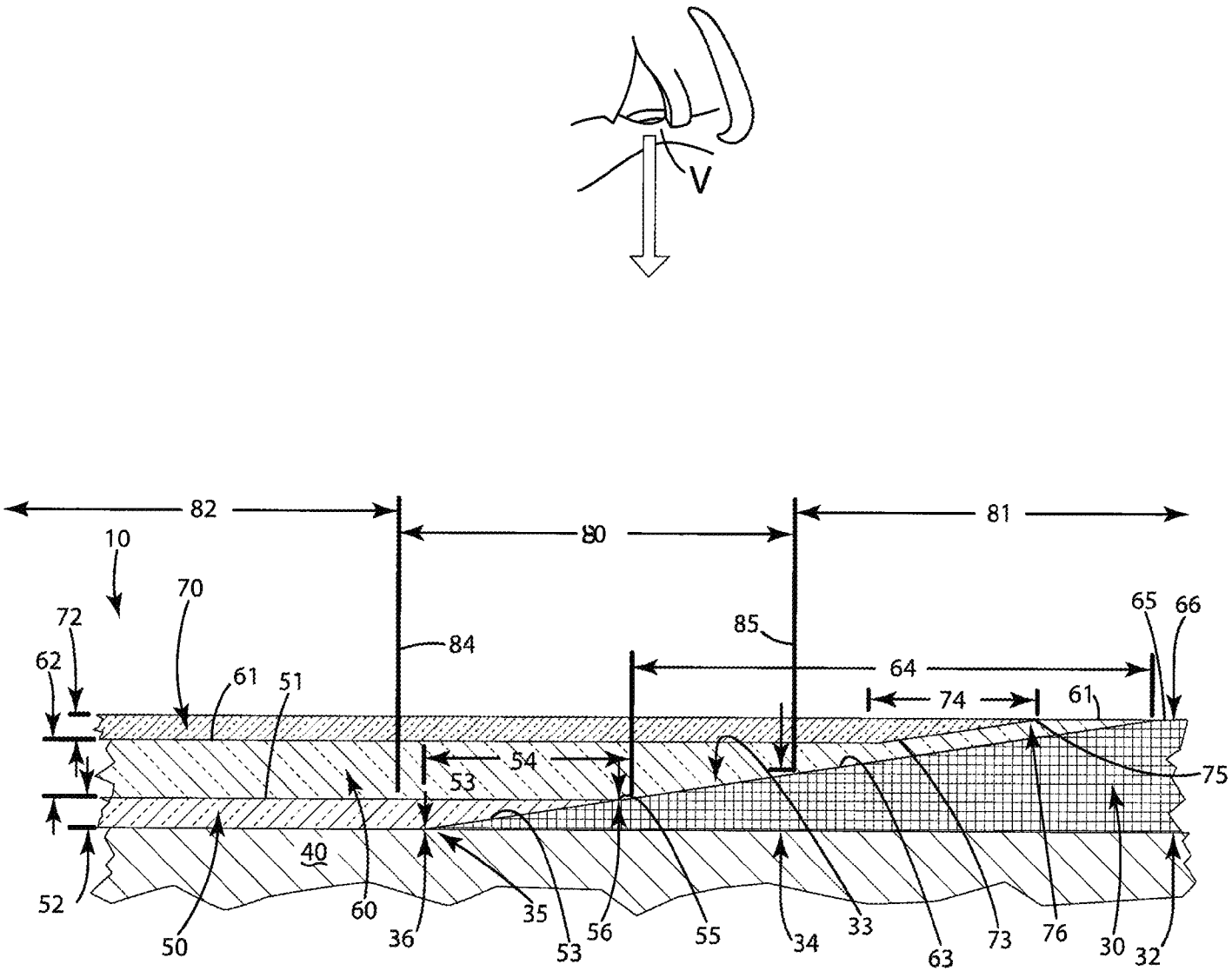
FIG. 6 is a cross section of a dark substrate surface treated with the method of the aspect of the first alternative embodiment of FIG. 5.
Figure 7:
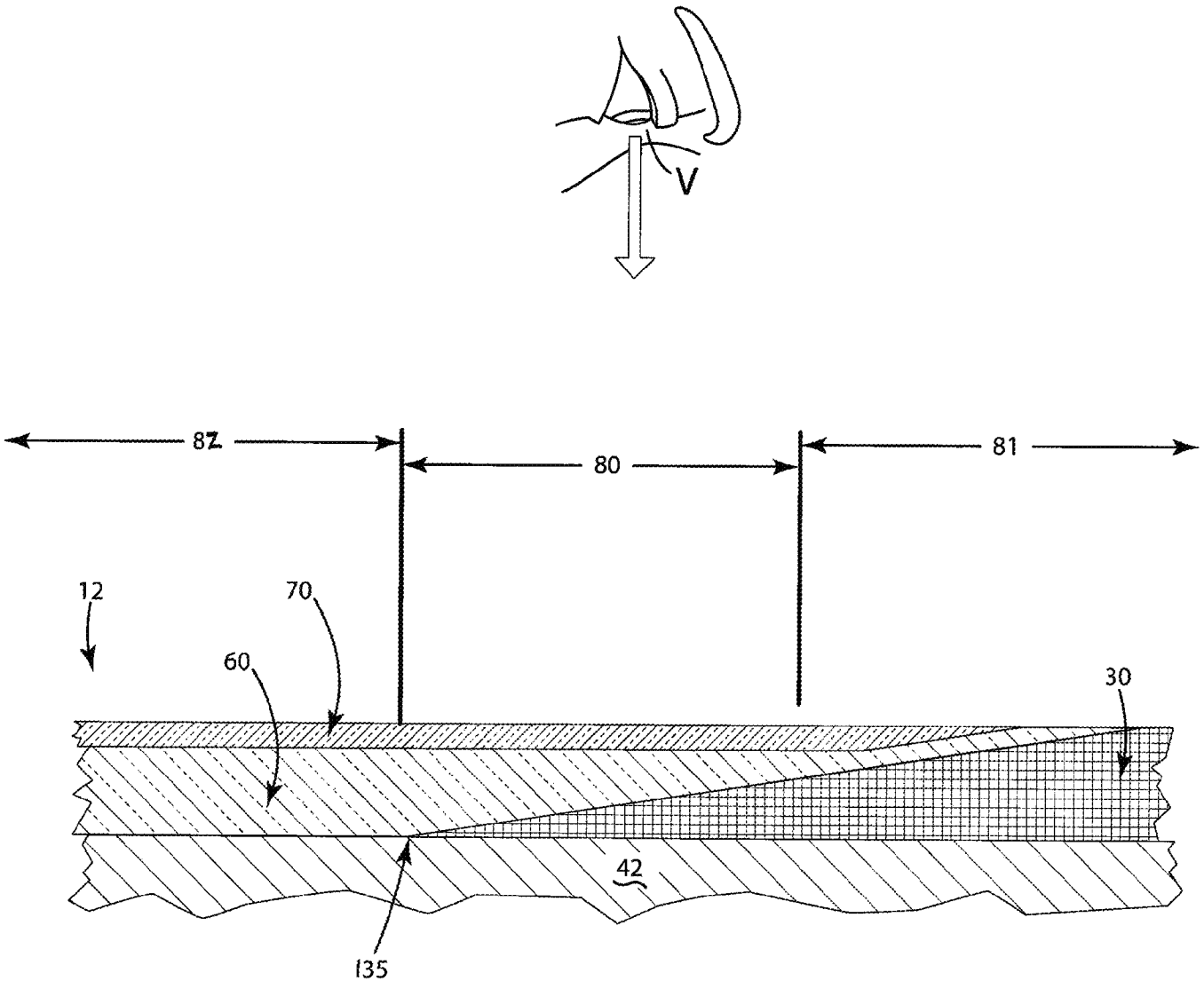
FIG. 7 is a cross section of a light substrate surface treated with the method of the aspect of the first alternative embodiment of FIG. 5.
Figure 9:
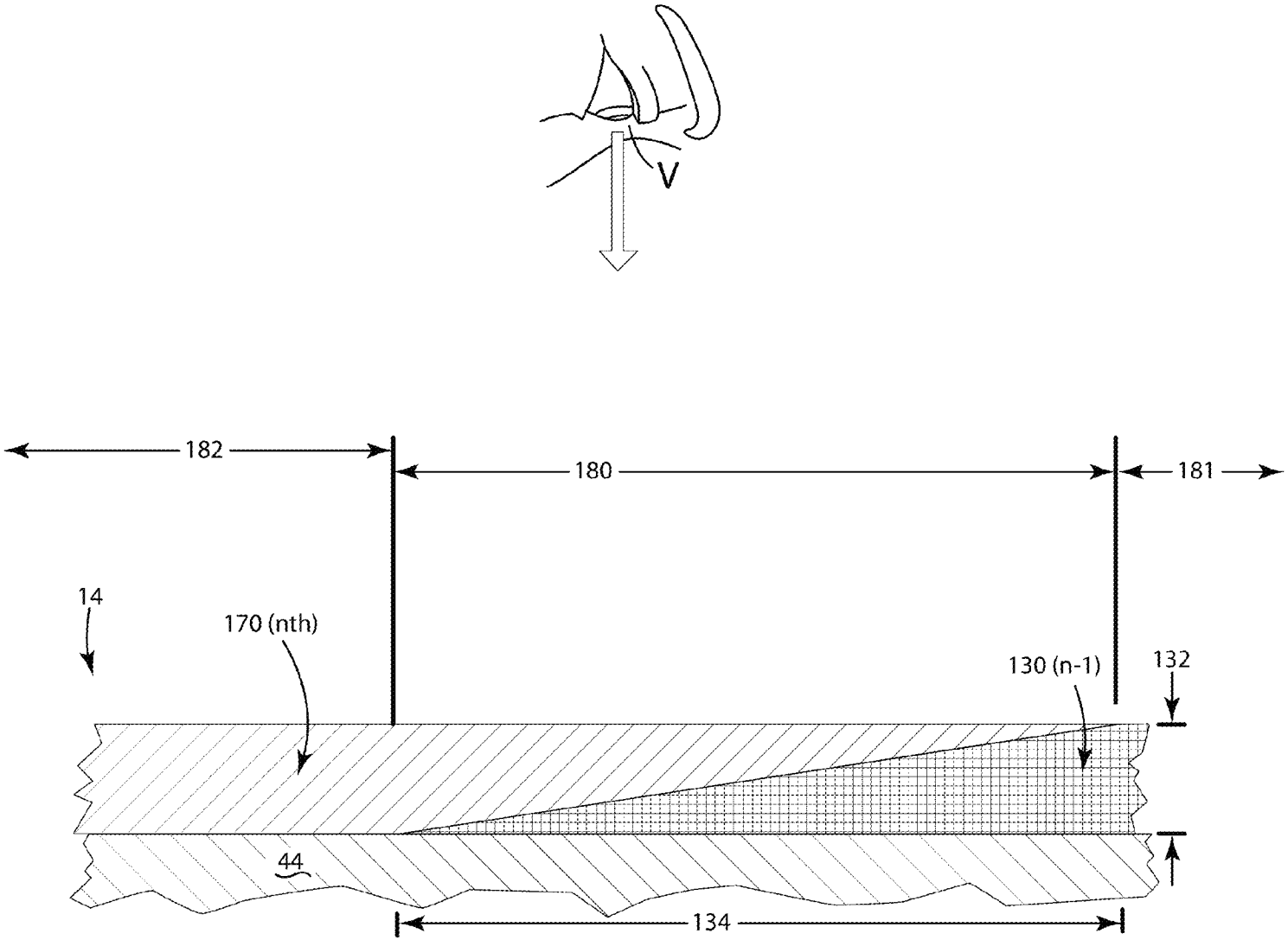
FIG. 9 is a cross section of a substrate treated with the method of the aspect of the first alternative embodiment of FIG. 8.
Figure 11:
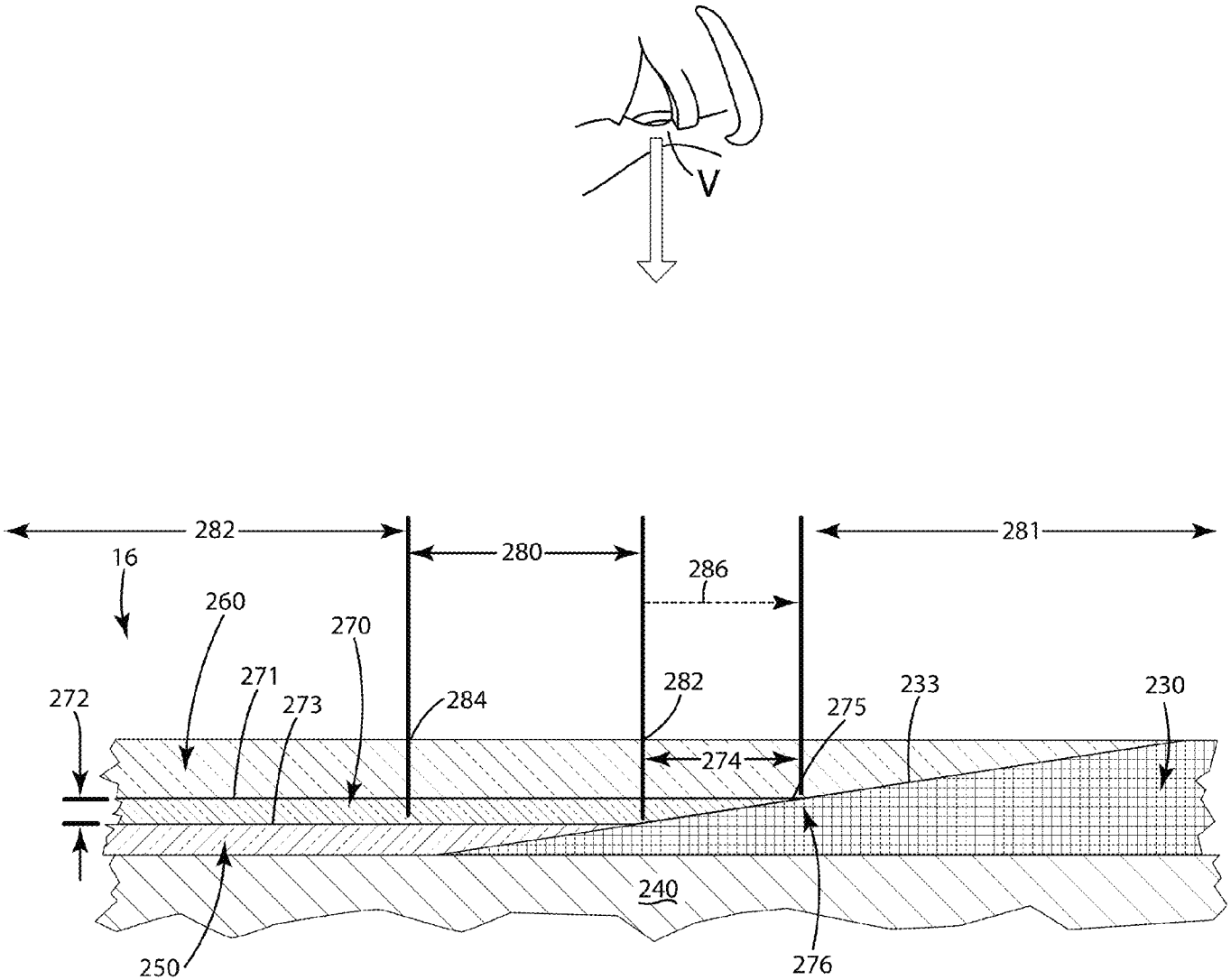
FIG. 11 is a cross section view of a substrate treated with the method of the aspect of the first alternative embodiment of FIG. 10.

A common feature of these three aspects is the transition region or "fade" zone created by the method on the substrate, and more generally, on the product to which the surface treatment is applied. This transition region can be readily perceived by a viewer of the product. As shown in FIGS. 6-7 and 11, in (B-1) and (B-3), within this transition region 80, 280, a color 30, 230 transitions, or gradually or non-abruptly fades (as perceived by a viewer V) to some form of decorative pattern 70, 270 and/or vice versa. As shown in FIG. 9, within this transition region 180, a first color 130 (n−1) transitions, or gradually or non-abruptly fades (as perceived by a viewer V) to a second color 170 ($n^{th}$), or another shade, hue or other variation of the first color.

Referring now to the aspect and associated sub-steps in the flow chart in FIG. 5, a decision (C) can be made as to whether or not the substrate is "dark". As used herein, a dark substrate is one having a shade of a color of any wavelength within the visible spectrum that approaches the appearance of black, or one that is black. From another perspective, on a monochromatic scale of 0 to 10, where white is 0 and black is 10, a "dark" substrate is scaled between 5 and 10, optionally between 7 and 10, and further optionally between 9 and 10 on the monochromatic scale.

If the decision (C) is made that the substrate is "dark" as defined above, steps (3)-(7) of FIG. 5 can be followed to prepare the product for the sublimation method in step (8). If the substrate is not determined to be "dark" as defined above then steps (3*a*), (6*a*) and (7*a*) of FIG. 5 are followed to prepare the product for the sublimation method in step (8), simplifying the preparation method for sublimation decoration method. In both steps (3) and (3*a*) of FIG. 5, the application method of the solid color powder coat is generally the same.

Of course, if a substrate or product is known to be dark or light, then the determination in (C) can be eliminated, with the method proceeding to the appropriate steps.

Cross sections of products treated with a surface treatment 10 are presented in FIGS. 6-7. These figures generally illustrate a dark substrate 40 or a light substrate 42, which optionally can form a part of an archery product, that is surface treated to include a solid color 30 layer and a decorative pattern 70, also optionally in the form of a layer. The decorative pattern layer can be applied using the sublimation methods as illustrated in FIG. 5. Generally, in FIGS. 6-7, the substrate 40 or 42, or more generally the product with which the substrate is associated, can be divided into a first region 81, a second region 82 and a transition region 80.

As shown in FIG. 6, a powder coat solid color layer 30 can be joined with the substrate 40 in the first region 81. Optionally, where the substrate is not electrically conductive, another special electrically conductive layer (not shown) may be interposed between the powder coat solid color layer 30 and the substrate 40. In the first region 81, the coating thickness can be optionally about 2.5 to about 5.5 mils, further optionally about 3.0 to about 5.0 mils and even further optionally about 3.5 to about 4.5 mils. The powder coat solid color layer 30 can also be joined with the substrate or an optional coating in the transition region 80, and as described below, can thin in thickness toward the second region 82.

In FIGS. 6 and 7, the powder coat solid color layer 30 diminishes in thickness within the transition region 80 to the location 35 or 135, where the thickness is about 0 mils. At or near the locations 35 or 135 of the different substrates of FIGS. 6 and 7, and more generally in the second region 82, different techniques can be used depending on how "dark" the substrate is.

For example, to prevent a dark substrate from bleeding through and overwhelming an overlying decorative pattern layer 70, such that the decorative pattern of that layer is not perceivable to or difficult to perceive by a viewer, in FIG. 6, a powder coat base coat layer 50 (step 4 in FIG. 5) having a color compatible with the decorative pattern 70 can be applied over the substrate 40 and optionally over a portion of the powder coat solid color layer 30, also referred to as a second powder coat layer herein.

Optionally, the additional thickness of the powder coat base coat layer 50 can be taken into consideration when planning the location, length and depth of the transition region or fade zone. Further optionally, where the substrate surface is "dark," the color of the powder coat base coat layer 50 can generally be less dark than the substrate surface 40. As an example, where the substrate surface 40 is in the range of 5-10 on the monochromatic scale described above, the color of the powder coat base coat layer can be in the range of 0-4 on the same monochromatic scale. As a further example, where the substrate surface is considered dark, the powder coat base coat layer can be of a second color, optionally different from the first color of the solid color layer. Suitable colors include but are not limited to tan, beige, grey, off white, and other lighter colors.

As shown in FIG. 6, a powder coat solid color layer 30 can be applied to the dark substrate 40. The powder coat solid color layer 30 can generally be of a uniform thickness 32, as dictated by the precision with which the coat can practically be applied, over most of the substrate and product where it is desired for a viewer to perceive the solid color. In the first region 81, the powder coat solid color layer 30 can be of a first thickness 32 diminishing to a second thickness 34. The first thickness can be optionally about 2.5 to about 5.5 mils, further optionally about 3.0 to about 5.0 mils and even further optionally about 3.5 to about 4.5 mils. Optionally, the powder coat solid color layer 30 on the remainder of the product can be of the same thickness.

In the transition region 80, the powder coat solid color layer 30 can begin with or generally be of a second thickness 34, which can be less than the first thickness 32. The difference can vary, depending on the desired appearance in the transition region 80.

Further, in the transition region 80, the second thickness 34 of the powder coat solid color layer 30 can diminish, generally from the second thickness 34, to a lesser thickness 36 at a boundary 35 of the powder coat solid color layer 30. The lesser thickness 36 can be about 0 mils to about 0.5 mils, further optionally about 0 mils to about 0.2 mils, and further optionally about 0 mils. Where the thickness is 0 mils, the solid color 30 terminates at the boundary 35 thereof. Of course, if desired, the powder coat solid color layer 30 can continue at some minimal or other thickness over more of the surface of the substrate, provided it does not visually overwhelm the overlying decorative pattern layer 70. For purposes of illustration here, it is assumed that the powder coat solid color layer 30 terminates at the boundary 35. Further, if desired, the second thickness 34 can remain relatively constant through the transition region (and other regions) or can vary as shown.

In the transition region 80 and generally where the solid color thins, the upper surface 33 of the powder coat solid color layer 30 is shown as generally planar for illustration purposes. Where the material forming the solid color coat 30 is sprayed on, the actual upper surface 33 may be of other topographies, for example, it may undulate, and be generally nonplanar. Accordingly, any other material joined with or coated over this surface 33 may also have a corresponding topography.

As further shown in FIG. 6, a powder coat base coat layer 50 can be applied to the dark substrate 40 for the reasons noted above. This powder coat base coat layer 50 can generally be of a uniform thickness 52 over portions of the dark substrate 40 where the decorative pattern 70 is desired to be viewed. In the transition region 54, however, the thickness can diminish from the first thickness 52 to a lesser, second thickness 56, which can be located at a boundary 55 of the base coat 50. The powder coat base coat layer thickness 52 can be about 0.5 mils to about 3.0 mils, further optionally about 1.0 mils to about 2.5 mils, and even further optionally about 1.0 mils to about 2.0 mils. The second thickness 56 can be about 0 mils to about 0.5 mils, further optionally about 0 mils to about 0.2 mils, and further optionally about 0 mils. Where the thickness is 0 mils, the powder coat base coat layer 50 optionally can terminate at the boundary 55. Further, if desired, the second thickness 56 can remain relatively constant in the transition region (and other regions) or can vary as shown.

In the transition region 80, the powder coat base coat layer 50 overlaps a portion of the powder coat solid color layer 30. The thickness of the base coat layer in this region can be metered by careful control of the application of the base coat layer by an operator. Moreover, although shown as a planar interface, the lower surface 53 of the powder coat base coat layer 50 can be of any configuration, and can generally correspond to the topography of the upper surface 53 of the powder coat solid color layer 30. Due to the thinning of the powder coat base coat layer 50 in sub region 54, the powder coat solid color layer 30 in that region can be faintly perceptible through the base coat there, particularly nearing the boundary 55. With the powder coat base coat layer 50 and solid color coat 30 applied, these powder coat layers can be baked as explained herein.

A powder coat clear coat layer 60, which can be transparent and/or translucent so that items can be at least partially viewed there through, can be applied over both the powder coat base coat layer 50 and the powder coat solid color layer 30 as shown in FIG. 6. The powder coat clear coat layer 60 can be applied via powder coating and baked as described above.

Generally the powder coat clear coat layer 60 can be of a uniform thickness 62 as dictated by the precision with which the coat can be applied over most of the base coat layer and/or substrate. The powder coat clear coat layer 60 can be applied in the second region 82, the transition region 80, and optionally in the first region 81. In the clear coat thinning region 64, the thickness of the clear coat layer 60 can diminish, generally from a thickness 62 also referred to as a first clear coat thickness, to a second clear coat thickness 66, at a boundary 65 of the clear coat. Further, if desired, the second thickness 66 can remain relatively constant in the transition region (and other regions) or can vary as shown.

The first clear coat thickness 62 can be about 0.5 mils to about 3.0 mils, further optionally about 1.0 mils to about 2.5 mils, and even further optionally about 1.0 mils to about 2.0 mils. Of course, other thicknesses for the clear coat can be selected depending on the application. The second clear coat thickness 66 can be about 0 mils to about 0.5 mils, further optionally about 0 mils to about 0.2 mils and further optionally about 0 mils. Where the thickness is 0 mils, the clear coat 60 optionally can terminate at the boundary 65. If desired, the powder coat clear coat layer 60 can continue at the boundary 35, farther over the powder coat solid color layer 30 to the extent desired. Indeed, the clear coat can extend completely over the solid color coat 30, and on other parts of the product if desired.

In the clear coat thinning region 64, the powder coat clear coat layer 70 overlaps a portion of the powder coat solid color layer 30. The lower surface 63 of the clear coat layer 60 also engages the upper surface 51 of the powder coat base coat layer 50 in the second region 82 and transition region 80. It also joins with the powder coat base coat layer as well as the powder coat solid color layer 30 where shown. Of course, the precise location of where the layers are joined may vary slightly depending on the application.

The thickness of the powder coat clear coat layer 60 in the second and transition regions, or in the first region if included there, can be metered by careful control of the application of the clear coat layer over the base coat layer and solid color layer 30. Moreover, although shown as a planar interface, the lower surface 63 of the clear coat layer 60 can be of any configuration, and can generally correspond with the topography of the upper surface 33 of the solid color layer 30 and/or the upper surface 51 of the base coat layer 50. Due to the transparent and/or translucent nature of the clear coat layer 60, the solid color layer 30 is visible through the clear coat layer 60, that is, where it is not fully obscured by the base coat layer 50 and/or a decorative pattern layer 70 as described further below.

Referring further to FIG. 6, the surface treatment 10 can further include a decorative pattern layer 70. This decorative pattern of this layer can be a camouflage pattern or other decorative finishes as described herein applied with a sublimation method, such as the Kolorfusion method described above. When a sublimation method is used, the decorative pattern layer 70 can generally form a very thin layer that is on and/or impregnated and/or penetrated into the upper surface 61 of the powder coat clear coat layer 60 by about 1 to about 2 mils, optionally about 0.5 to about 1 mils, and further optionally about 0.25 mils.

Optionally, the decorative pattern layer 70 is located above the powder coat clear coat layer 60, or some other layer, in the second region 82, the transition region 80, and optionally the first region 81. When a sublimation method is used, the decorative pattern layer can be at least partially impregnated in or transferred into or onto the powder coat layer 60, with the powder coat layer itself holding some of the materials of the decorative pattern layer. In such a state, the decorative pattern layer can still be considered to be located "above" the lower layer, even though it is included at least partially and/or wholly within the lower layer.

In general, the decorative pattern layer 70 can be of a uniform thickness 72, which again can form a portion of the powder coat clear coat layer 60, over most of the substrate where it is desired for a viewer to perceive the decorative pattern layer 70. In the thinning region 74, the thickness of the decorative pattern layer 70 can diminish, generally from the thickness 72 to a thickness 76 at a boundary 75 of the decorative pattern layer 70. The thickness 72, also referred to as the first thickness, can range from about 1.0 to about 2.0 mils, further optionally about 1.0 to about 1.5 mils, further optionally about 0.5 to about 1.0 mils, and even further optionally about 0.25 mils. Further, although shown as including a thinning region 74, the decorative pattern layer 70 can terminate abruptly, that is, stop at a generally vertical line or edge without thinning or tapering from a first thickness to a second thickness over a preselected distance. Optionally, any of the other layers 30, 50 and 60 also can terminate at such an abrupt edge.

Where the thinning region 74 is included, the second thickness 76 can be about 0 mils to about 0.5 mils, further optionally about 0 mils to about 0.2 mils, and further optionally 0 mils. Where the thickness is 0 mils, the decorative pattern layer 70 terminates at the boundary 75. Of course, the decorative pattern layer 70 can continue over the solid color if desired. In the regions where it continues over the solid color, the decorative pattern layer, however likely, will be unperceivable by a viewer because it is overwhelmed by the solid color.

In the decorative pattern layer thinning region 74, the lower surface 73 of the decorative pattern layer 70 is shown as generally being planar. Depending on the color and the particular sublimation method, however, the actual lower surface 73 can be of a variety of other topographies. For example, it may undulate and can be generally non-planar.

Optionally, in some applications, the decorative pattern layer 70 can be substituted with a color layer that includes one or more colors, for example, but not limited to, a solid color described above, rather than, or in combination with, a decorative pattern as described above. In such an application, the inks, dyes or other materials that make up the color layer can be transfer printed to the underlying powder coat layer or substrate or product using any of the sublimation, hydrographics or other methods described herein. Further optionally, the color layer can be constructed with the same materials as the decorative pattern layer described above, but will have an appearance of a color layer rather than a decorative pattern. The color layer also can be a non-powder coat layer, that is, it is not powder coated on a lower layer or generally is not of a powder coat construction. Finally, where the decorative pattern layer is optionally substituted with the aforementioned color layer, that color layer can fade and otherwise transition into the aforementioned powder coat color layers similar to the way the decorative pattern layer transitions into the powder coat color layers as described in the embodiments herein.

In the transition region 80 of FIG. 6, the decorative pattern layer 70 generally fades or transitions so that the solid color coat layer 30 is more readily perceptible moving from left to right of FIG. 6. Generally, at the end 85 of the transition region 80, the decorative pattern layer 70 is largely imperceptible to a viewer V because the underlying solid color of the powder coat solid color layer 30 begins to blur out and overwhelm the coloration, detail and/or visual appearance of the overlying decorative pattern layer 70 almost entirely at this location 85. At the location 84, the decorative pattern layer is fully visible to the viewer V. The underlying lighter base coat 50 does not overwhelm or blur or otherwise distort the perceivable colors, details, patterns or other features of the decorative pattern 70 beyond the region to the left of location 84 in FIG. 6.

Optionally, in the transition region 80 the base coat layer 50 can also include a thinning region 54. Accordingly, the perceived fade of the decorative pattern layer 70 can be enhanced due to the visual bleed through of the underlying powder coat solid color layer 30 through the thinning base coat layer 50.

Figure 12:
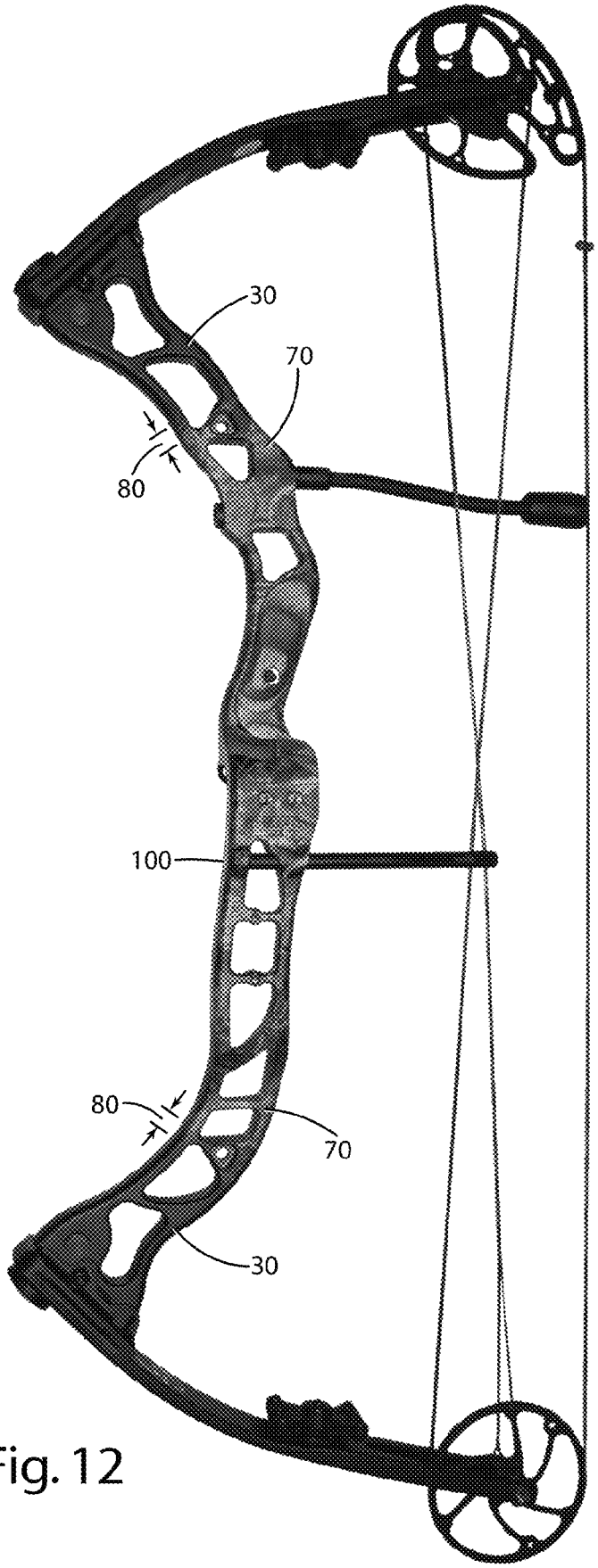
FIG. 12 is a photograph of a side of an archery bow treated with an aspect of the first alternative embodiment illustrating transitions between a decorative pattern and a solid color.
Figure 13:
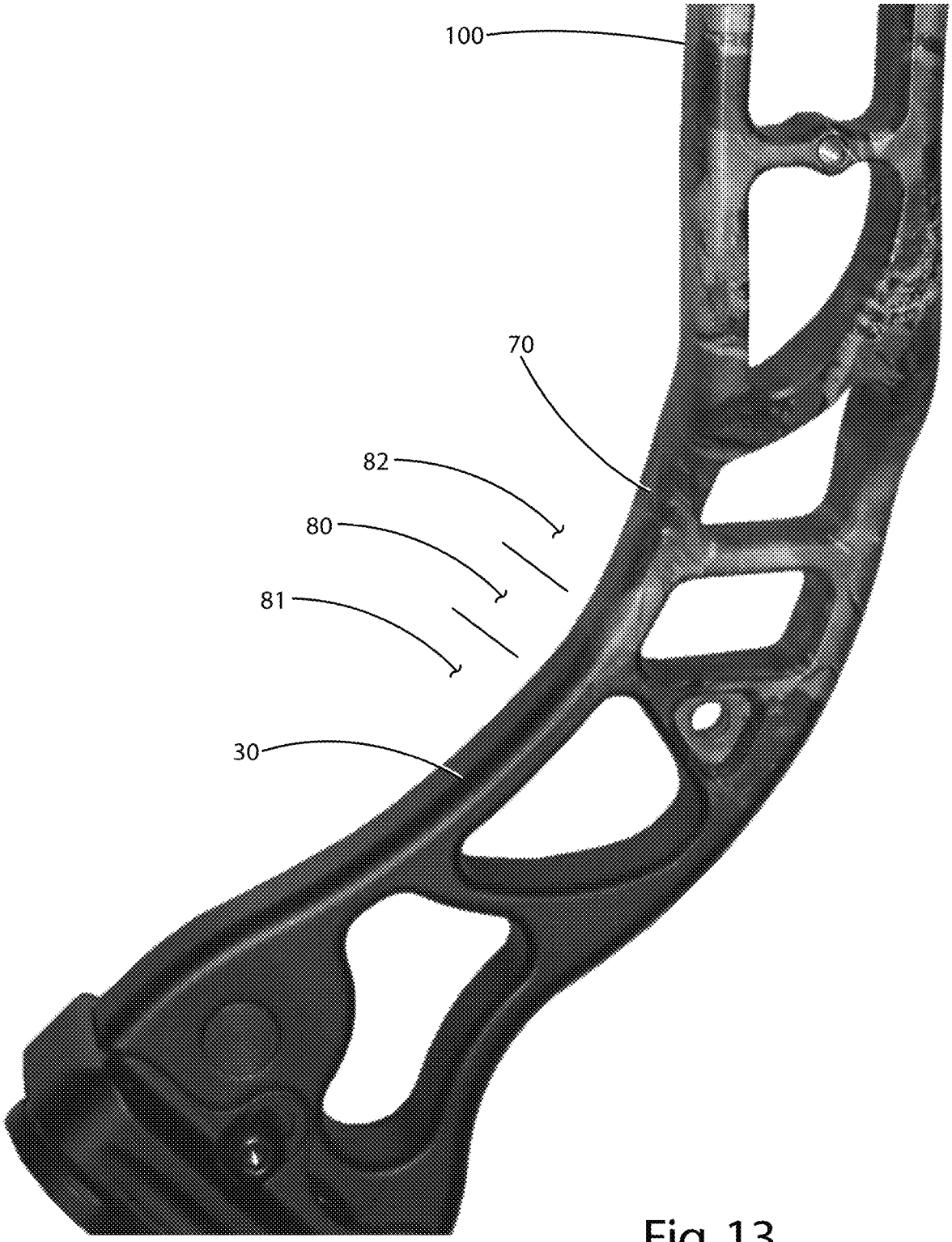
FIG. 13 is a close up photograph of the side of the archery bow illustrating a fade of the decorative pattern to the solid color in a transition region.

To better understand the visual effect provided by the surface treatment 10, FIGS. 12 and 13 are images of an archery product, and in particular a compound archery bow 100 that has been treated with the aforementioned method. As shown there, the bow 100 includes a first decorative pattern 70 that is generally in the form of a camouflage pattern. As shown in FIG. 13, this decorative pattern 70 in region 82 transitions to the solid color coat layer 30 in region 81, which is illustrated as being black. The transition occurs in the transition region 80. There, the camouflage features and details of the decorative pattern 70 gradually fade out into the black over a distance of about 1 to about 2 inches. At the end of the transition region 80, the camouflage pattern is imperceptible to a viewer, so that the portion of the bow beyond that region and into region 81 appears black. Optionally, the placement of the colors and decorative pattern can be reversed and can be positioned on virtually any other portions of the archery bow as desired. For example, with regard to the archery bow riser illustrated in FIGS. 12 and 13, the camouflage pattern and solid color (black) could be reversed, with the upper and lower parts of the riser and limbs including the decorative pattern (the camouflage pattern), and with the central part of the riser including the solid color (black).

The aspect (B-1) in FIG. 5 can also be used to apply a surface treatment using sublimation to a product or substrate 42 that is generally not considered a dark substrate, like that described above in connection with FIG. 6. Such "lighter" substrates can have the lighter characteristic due to the material from which they are made, or from a special coating applied to the substrate, or for other reasons. As an example, substrates constructed from or including a fair amount of aluminum or magnesium generally are not considered to be a dark substrate.

Where the substrate 42 is not dark, or is generally a light substrate, steps 3*a*, 6*a*, 7*a* and 8 can be followed as shown in FIG. 5 and described above. The structure of a surface treatment 12 generated by these steps is illustrated in FIG. 7. There, the surface treatment 12 includes most of the same features of the surface treatment 10 of FIG. 6. The primary difference again is that the substrate 42 is a light colored substrate, rather than a dark substrate. Accordingly, the powder coat base coat layer 50 can be eliminated from this surface treatment 12. In which case, the powder coat clear coat layer 60 can be applied directly to the substrate 42, and can be considered a second powder coat layer, and the powder coat color layer 30 can be considered the first powder coat layer as described elsewhere herein.

The other features and characteristics of the powder coat solid color layer 30, the powder coat clear coat layer 60 and the decorative pattern 70 can be virtually the same as those illustrated in FIG. 6 and described above. An exception, however, is that with the base coat layer eliminated, the clear coat layer 60 can be slightly thicker in the embodiment of FIG. 7, by about 0.5 mils to about 3.0 mils, further optionally about 1.0 mils to about 2.5 mils and further optionally about 1.0 mils to about 2.0 mils. The method to produce the surface treatment generally can be the same, with the exception that the powder coat base coat layer 50 is not applied to the substrate or solid color coat, and that the powder coat solid color layer 30 and the powder coat clear coat layer 60 can be baked and cured on the substrate in the same baking step.

A cross section of a product treated with a surface treatment 14 is presented in FIG. 9. This figure generally illustrates a substrate 44, which optionally can form a part of an archery product, that is surface treated to include a first powder coat solid color layer 130 that transitions to a second powder coat solid layer 170. The different layers can be applied using the aspect (B-2) of the embodiment illustrated in FIG. 8. Generally, in FIG. 8, the substrate 44, or more generally the product with which the substrate is associated, can be divided into a first region 181, a second region 182 and a transition region 180. In the transition region 180, the first powder coat solid color layer 130 fades into to the second powder coat solid layer 170, or vice versa as explained above in connection with the decorative pattern and solid color layer of FIGS. 6 and 7.

Optionally, however, the aspect of the first alternative embodiment (B-2), may be expanded beyond the blending and fading of only two solid colors. As shown in FIG. 8, theoretically any number, from two solid colors (step 4*a*) to "n" solid colors (step 4*n*), may be transitioned or faded into their adjoining colors. As shown in FIG. 9, in mathematical terminology, the "$n^{th}$" or final solid color layer 170 transitions into the "(n−1)" immediately preceding solid color layer 130. The number of powder coated solid color layers used may be governed by the size of the product in relation to the number and length of the transition zones. In a further embodiment of the above noted fading method, the transition region can include more than two solid colors layers that fade into each other. The powder coat application of all the solid color layers can precede the baking operation (step 5*a*). Ultimately, the total film thickness shown in FIG. 9 can range from about 2.0 mils to about 4.0 mils.

As shown in FIGS. 8 and 9, a first powder coat solid color layer 130 (n−1) as described above is applied to the substrate 44. If desired, the substrate 44 can be categorized as light or dark as noted in step (B-1) of FIG. 5 so that the appropriate powder coat solid color layers are matched to the substrate. The first powder coat solid color layer 130 (n−1) can generally be of the uniform thickness and can generally include a thinning region 134 in the transition region 180 of diminishing thicknesses. A second powder coat solid color layer 170 ($n^{th}$) can be applied over a portion of the thinning region 134 of the first powder coat solid color layer 130 (n−1). The thickness of the second powder coat solid color layer 170(*e*) can vary from a first thickness to a second thickness in its own thinning region, corresponding to the thinning region 134 of the first powder coat solid color layer 130 (n−1) in the transition region 180. Although illustrated as planar, the interface between the second powder coat solid color layer 170 ($n^{th}$) and the first powder coat solid color layer 130 (n−1) can be non-planar and can undulate, depending on the techniques used to apply the particular materials.

The resulting second powder coat solid color layer 170 ($n^{th}$) can overlap the thinning region of the first powder coat solid color layer 130 (n−1). Moving from left to right in the transition region 180 of FIG. 9, the second powder coat solid color layer 170 ($n^{th}$) m) becomes less and less perceptible, while the first powder coat solid color layer 130 (n−1) becomes more perceptible to a viewer V. To the right most portion of FIG. 9, the first powder coat solid color layer 130 (n−1) can completely overwhelm the second powder coat solid color layer 170 ($n^{th}$) so that only the first powder coat solid color layer 130 (n−1) is perceivable by a viewer. As with the other aspects above, with the powder coat solid color layers applied, these layers can be baked and optionally clear coated with another powder coat or other layer as described herein.

A cross section of a product treated with a surface treatment 16 is presented in FIG. 11. This figure generally illustrates a substrate 240, which optionally can form a part of an archery product surface treated to include a first powder coat solid color layer 230 that transitions to a decorative pattern 270. The different layers can be applied using the aspect (B-3)

of the embodiment illustrated in FIG. 10. Generally, in FIG. 11, the substrate 240, or more generally the product with which the substrate is associated, can be divided into a first region 281, a second region 282 and a transition region 280. In the transition region 280, the decorative pattern 270 appears to fade into to the first powder coat solid layer 230, or vice versa as explained above in connection with the decorative pattern and solid color layer fading of FIGS. 6 and 7.

As described in FIGS. 10 and 11, however, the decorative pattern 270 is applied via a specific transfer printing, namely via hydrographic or water transfer printing as explained above. As illustrated in FIG. 11, the powder coat solid color layer 230 is applied to the substrate 240. This powder coat solid color layer 230 can include similar features, structure and dimension as the powder coat solid color layer 30 described above in connection with FIG. 6. A powder coat base coat 250 can also be included in this surface treatment 16. This powder coat base coat layer 250 can include similar features, structure and dimension as the powder coat base coat layer 50 of FIG. 6 as well.

The powder coat base coat layer 250 and powder coat solid color layer 230 can overlap in portions of corresponding thinning regions like those regions 34 and 54 described in connection with the surface treatment of FIG. 6. Optionally, in some applications where the substrate 240 is compatible with the decorative pattern layer 270, the powder coat base coat layer 250 can be eliminated, and the decorative pattern 270 can be applied directly to the substrate surface via water immersion and hydrographic techniques as described herein.

Returning to FIGS. 10 and 11, the powder coat base coat layer 250 and powder coat solid color layer 230 can be baked as explained herein. After baking, a decorative pattern layer 270 can be applied via immersion and/or water transfer printing method as described herein. The decorative pattern layer 270 generally is of a first thickness 272 which is uniform over the powder coat base coat layer 250 in the desired region. The first thickness 272 can diminish to a second thickness 276 in the thinning region 274 of the decorative pattern layer 270. The first thickness can be about 1 thousandths of an inch to about 3 thousandths of an inch, further optionally about 2 thousandths of an inch thick. A second thickness can be about 0 thousandths of an inch to about 0.5 thousandths of an inch, further optionally about 0 thousandths of an inch thick. Where the thickness is 0 thousandths of an inch, the decorative pattern layer 270 can terminate at the boundary 275.

In the decorative pattern layer thinning region 274, the first surface 233 is shown as being generally planar for illustrative purposes. As described in connection with the surface treatment of FIG. 6, however, the upper surface 233 can be non-planar and can include varying topography. The lower surface 273 of the decorative pattern layer 270 accordingly may be of the same topography, corresponding to that of the upper surface 233 of the powder coat solid color layer 230 as desired. Moreover, although shown as thinning from the first thickness 272 to a second thickness 276 in a thinning region 274, the decorative pattern layer 270 can end abruptly at a vertical line or an edge, with the edge generally being of the same thickness as the first thickness 272. That edge can be positioned over the base coat and/or the upper surface 233 and the powder coat solid color layer 230 as desired. Further, although shown as terminating adjacent the powder coat base coat layer 250, the decorative pattern layer 270 can extend into and over the entire powder coat solid color layer 230 or additional regions.

Optionally, in some applications, the decorative pattern layer 270 can be substituted with a color layer that includes one or more colors, for example, but not limited to, a solid color described above, rather than, or in combination with, a decorative pattern as described above. In such an application, the inks, dyes or other materials that make up the color layer can be transfer printed to the underlying powder coat layer or substrate or product using any of the sublimation, hydrographics or other methods described herein. Further optionally, the color layer can be constructed with the same materials as the decorative pattern layer described above, but will have an appearance of a color layer rather than a decorative pattern. The color layer also can be a non-powder coat layer, that is, it is not powder coated on a lower layer or generally is not of a powder coat construction. Finally, where the decorative pattern layer is optionally substituted with the aforementioned color layer, that color layer can fade and otherwise transition into the aforementioned powder coat color layers similar to the way the decorative pattern layer transitions into the powder coat color layers as described in the embodiments herein.

As shown in FIG. 11, the surface treatment 16 also can include a powder coat clear coat layer 260 over the decorative pattern layer 270 and the powder coat solid color layer 230. This powder coat clear coat layer 260 can have the same features and properties and structure as the powder coat clear coat layer 60 described in connection with the surface treatments of FIGS. 6 and 7 above, with the exception of that there optionally is not a decorative pattern layer impregnated in it via a sublimation method.

In the transition region 280 of FIG. 11, the decorative pattern layer 270 blends or fades into the powder coat solid color layer 230 so that the solid color layer 230 is more readily perceptible to a viewer moving from left to right of FIG. 11. Generally, at the region to the left of location 284 in FIG. 11, the decorative pattern 270 is clearly perceptible and not obscured or blurred by any underlying layers. In the transition region 280, that is, between location 284 and 282, the underlying solid color layer 230 becomes more and more visible, and gradually begins to blur out and overwhelm the coloration, detail and/or visual appearance of the overlying decorative pattern layer 270.

Generally, at location 282, the decorative pattern of the decorative pattern layer 270 is unperceivable by the viewer V, with the powder coat solid color layer 230 being primarily viewable by the viewer V. In some cases, for example, where the decorative pattern layer 270 is particularly thick, the transition region can extend a pre-selected distance 286 further overlapping the powder coat solid color layer 230.

A more general description of the steps included in the aspects (B-1), (B-2) and (B-3) of the first alternative embodiment will now be described. To begin, the initial powder coat color coat layer in steps (3) or (3*a*) of the flows of FIGS. 5, 8 and 10 can be applied directly to the substrate or the conductive coating (where employed) depending on the substrate. Based on the method selected at decision point (B) of FIG. 4, the initial color coat can be followed by a base coat (step 4), one or more color coats (step 4*n*), or a clear coat (step 6*a*) of the flows of methods in FIGS. 5, 8 and 10. A baking operation follows, after which a very thin but durable coating is achieved that can ensure a highly successful subsequent, optional, decorative pattern, such as transfer printing. The thinner base coat can allow the decorative pattern to be transfer printed with minimal distortion, and without obscuring minute details on the product.

On product where aesthetics or appearance is an issue, a thinner coating, for example about 1.0 mils to about 3.0 mils, can enable the retention of original detail not possible with the heavier coatings normally associated with powder coating. On products where dimensional tolerances are diminutive, particularly mating surfaces, (such as sliding dovetails) the current embodiments achieve the desired closeness of fit not previously realized.

Precise control of the application of the powder coat color layers, which need not necessarily be solid color layers, in steps (3) of the follow charts in FIGS. 5, 8 and 10 can achieve the results described above. Such control can be achieved by using specialized equipment for the electrostatic deposition of the powder coat material for the powder coat base coat layers as described in connection with the embodiments above.

After satisfactory application of the powder coat color layers and/or powder coat base coat layers, the products can be placed on racks that are placed in a baking oven, as recited in steps (5) of method aspects (B-1), (B-2) and (B-3), shown in FIGS. 5, 8 and 10, respectively. The temperature of the oven can be thermostatically controlled to a target value, optionally 365° F. to 385° F., further optionally 370° F. to 380° F., and even further optionally 375° F. The length of time in the bake cycle can be a function of product size and complexity of the surface features of the product, and can vary from 10 to 30 minutes, optionally 15 to 25 minutes, and further optionally 18 to 22 minutes.

After adequate baking on of the powder coat color coat and base coat in step (5) in FIGS. 5, 8 and 10 the racks with the powder coated products optionally can be removed from the oven, placed in a cooling area and allowed to cool before further processing.

The materials used for the base coat and/or color coat of steps (3) and (4) of the aspects in FIGS. 5, 8 and 10 can be any of the materials of the colors shades, values and/or hues mentioned in the current embodiments above. A similar selection is available for the degree of gloss of the finished base and/or color coat, ranging from flat to a high gloss. The degree of gloss can be enhanced by the application of a clear coat layer, which can be useful for those products that are not to be decorated, for example, products that follow the method aspect (B-2) depicted in FIG. 8. The method steps of clear coat application step (6) and clear coat baking step (7) would apply subsequent to a "yes" at decision point (C) in FIG. 8.

When the end product is not to be decorated, such as in method aspect (B-2) in FIG. 8, then the color selection is virtually unlimited for the color coats in steps (3) and (4*a* to 4*n*). However, when the product is to be decorated, such as in the method flows of FIG. 5 aspect (B-1), sublimation transfer printing, and FIG. 10 aspect (B-3), immersion or water transfer printing, the base coat layer applied in step (4) of the respective flow charts in FIGS. 5, 8, and 10 can be selected so that underlying color is compatible with the colors in the transferred pattern, and so that the base coat color does not overwhelm the pattern or details of the transferred pattern as explained in detail above.

When the product is to be decorated as in the method aspect (B-3) of FIG. 10, by immersion or water transfer printing, then the base coat layer applied in step (4) of that figure can be selected to be compatible color wise with the transferred decorative pattern, and to accept the inks of the printed decorative pattern, as described above.

The aspect of the methods shown in FIG. 5, steps (6) and (7), and alternatively (6*a*) and (7*a*), depict the application and baking of a powder coat clear coat before transfer printing a decorative pattern by the sublimation method. FIG. 8, steps (6) and (7) depict the application and baking of a clear coat layer at least partially over a solid color layer. FIG. 10 steps (9) and (10) depict the application and baking of the powder coat clear coat layer following decoration by immersion or water transfer printing.

The clear coat layer application of steps (6) and (6*a*) of FIG. 5, step (6) of FIG. 8, and step (9) of FIG. 10, can follow the same procedures and utilize the same equipment as that described for the color coat and/or base coat application. Similarly, the clear coat layer baking in steps (7) and (7*a*) of FIG. 5, step (7) of FIG. 8, and step (10) of FIG. 10, can follow the same procedures and utilize the same equipment as that described for the color layer and/or base coat layer baking methods as noted above in connection with the current embodiments.

The film thickness of the clear coat layer can depend on its intended function. It may serve as the interface for transfer printing by sublimation (refer to steps (6), (6*a*), (7) and (7*a*) in FIG. 5), a final coat over a color coat (refer to steps (6) and (7) in FIG. 8), or as the final coat in water transfer printing (refer to steps (9) and (10) in FIG. 10). It may range optionally between about 0.5 and about 5.0 mils, further optionally between about 1.0 and about 3.0 mils, and even further optionally between about 1.5 and about 2.5 mils.

For product that is decorated by the sublimation method, as in FIGS. 5-6, the clear coat layer can serve as the interface on which the inks or materials of the decorative pattern are deposited in or on or otherwise transferred to. The clear coat layer material can be compatible with and can be able to accept the inks of the printed decorative pattern. A suitable clear coat material can be any variety of acrylic coatings as described above.

When the decorative pattern is to be transfer printed via hydrographic or water immersion printing, as in FIG. 10, the clear coat layer can be applied and baked (steps 9 and 10) after the transfer printing (step 8) and can serve as a protective coating for increased durability.

When the product is not to be decorated, but will include a clear coat layer (refer to steps (6) and (7) in FIG. 8), a broad selection of materials may be used. In these applications, the clear coat layer may serve the function of enhancing the gloss or the durability of the color layer or a combination of both. The clear coat layer application (6) and baking methods (7) can follow the same procedures and utilize the same equipment as that described for the application method (steps 3 through 4*n*) and baking method (step 5) for the color coat layer described above. The clear coat layer may range in thickness, optionally between about 0.5 and about 5.0 mils, further optionally between about 1.0 and about 3.0 mils, and even further optionally between about 1.5 and about 2.5 mils.

Optionally, any of the surface treatments produced with any of the aspects described above can be treated with a protective coating, which can improve the durability of the underlying surface treatment layers. For example, a clear, transparent and/or translucent protective coating, such as a lacquer, varnish, or polymeric film, can be coated or otherwise joined with and over the uppermost surfaces of the uppermost layers of FIGS. 6, 7, 9 and 11. This protective coating can enable a viewer to view the underlying surface treatment layers, yet provide improved weatherability, improved abrasion or chip resistance, improved UV degradation resistance, and/or other protection to the underlying surface treatment layers. This protective layer can be applied using any conventional coating techniques, such as spray on, brush on, or roll on techniques, powder coating, and the like.

The following are examples of the first alternative embodiment described above. These examples are provided for illustrative purposes only, and are not intended to limit the above embodiments.

Example 3

In this example, an aluminum compound bow riser is prepared as illustrated through step (B) in FIG. 4. The prepared aluminum riser may thereafter be processed as desired.

After machining the riser, the steps (A) and (1) are followed. Because the riser is aluminum (metal), the riser is prepared as follows; the riser and related parts are placed in a washer, washed in Krud Kutter/Hot Water solution for 2-3 minutes, and removed. Screws are inserted in threaded holes defined by the riser to protect the threads. The riser is then media blasted in a hand sand blaster using white silica until matte finish is achieved.

With the riser prepared, referring to FIG. 4 at step (B), the flow method (B-2) in FIG. 8 is selected to method the riser with a solid color transitioning to a second solid color as shown in FIG. 9. The method proceeds to step (3) in FIG. 8. There, the first powder coat color layer, of the color flat smooth black, is applied to a portion of the riser blending from a heavy coat to a light coat in the transition region. To do so, the material is loaded in the hopper. The air pressure is adjusted to 0.75 pounds per square inch. The operator starts the hopper, and checks for agitation motion of powder in hopper. The operator switches on powder coat station draw units, and places the risers on electrically charged hooks.

As shown in FIG. 9, the operator powder coats the riser starting at one end with the first powder coat solid color layer 130 (n−1) until the riser is covered to the desired transition region 180 and first region 182. To achieve the diminishing coating thickness of the solid color layer 130 (n−1) in the transition region 180, the distance between the gun nozzle and the riser is gradually increased through the length of the transition region to a maximum of 12 inches at the point where the desired thickness is zero.

The method then proceeds to step (4*a*) of FIG. 8 where a second powder coat solid color layer 170 ($n^{th}$) is applied in the same manner as the first powder coat solid color layer 130 (n−1) starting from the opposite end of the riser, blending a heavy coat into the transition region 180 established by the first powder coat solid color 130 (n−1). The thickness of the second powder coat solid color layer 170 ($n^{th}$) can be the same as, greater than or less than, the first powder coat solid color 130 (n−1) as desired outside the transition region 180, for example, in the second region 181. The length of the transition region 180 can be about 0.5" to about 10.0", optionally about 1.0" to about 8.0", and further optionally about 2.0" to about 6.0".

The operator removes the riser from the hook and places it in a rack. With the application of the first and second solid color layers completed in steps (3) and (4*a*), the riser is baked in step (5) of FIG. 8. To do so, the rack including the riser is placed in an oven pre-heated to specified temperature, for example, 380° F. The riser is baked at a specified temperature, for example, 380° F. for a specified time, for example, 18 minutes. Thereafter, the rack including the riser is removed from the oven and placed in a cooling area. The operator removes the cooled riser from the rack, inspects the riser, and moves it to the next desired operation.

Example 4

In this example, fiberglass composite compound bow limbs are powder coated and decorated following the flow method (B-1) in FIG. 5, after having been prepared by the method in FIG. 4. For example, referring to FIG. 4, after machining the limbs, steps (A), (A1) and (1*a*) are followed. Because the limbs are non-metallic/non-wood, they are prepared by placing 70 pieces/load in a tumbler and tumbled for 2 hours with abrasive media. The limbs are rinsed with hot water and blown dry. The limbs undergo a deflection test and are stamped.

In step (2) of FIG. 4, an electrically conductive coating is applied. To do so, the limbs are sprayed with the electrically conductive coating through a conventional atomizer. At step (B) in FIG. 4, flow method (B-1) is selected, a solid color transitioning to a decorative pattern decoration by sublimation. The limbs are moved to a powder coat spray booth to apply a first powder coat color layer while the electrically conductive coating is still wet. Referring to step (3) of FIG. 5, a flat smooth black powder coat color layer is applied to a portion of the riser blending from a heavy coat to a light coat in the transition region 80 in substantially the same manner as described in Example 1 of this embodiment. In step (4) of FIG. 5, a powder coat base coat layer 50 available from PPG Industries of Southfield, Mich. is applied in substantially the same manner as the powder coat color layer but starting from the opposite end of the limb and blending into the transition region 80 established by the powder coat color layer 30 as shown in FIG. 6. The powder coat color layer 30 and the powder coat base coat layer 50 are simultaneously baked onto the limbs in substantially the same manner as described in Example 1 of this embodiment. Thereafter, the rack with the limbs is removed from the oven and placed in a cooling area. The operator removes the cooled limbs from the rack, inspects them, and moves them to the next desired operation.

Steps (6) and (7) in FIG. 5 follow. Specifically, a powder coat clear coat layer 60, e.g., a low gloss clear powder coat is applied and baked using substantially the same techniques described above in Example 1 of this embodiment. In step (6), the powder coat clear coat layer 60 is applied starting in the area of the heavy application of the powder coat base coat layer 50 and finishing past the transition region 80 and in the first region 81 as illustrated in FIG. 6. After baking, step (7), the limbs are cooled in the rack, removed from the rack, inspected, and moved to staging site for the sublimation method of step (8).

In the sublimation, the following steps are performed. An operator selects a desired pattern of transfer printing fabric with specified pattern reduction (e.g. RealTree® AP @ 50%). The operator pre-assembles a plastic bag by attaching air connector and sealing bottom of bag. The operator surrounds each limb with transfer printing fabric and places it in a pre-assembled plastic bag. The operator connects an air connector on the plastic bag through a hose to vacuum source. The vacuum source applies a vacuum (~25" Hg). The operator ensures that all selected areas of the product are being covered with printing fabric while applying vacuum. The operator can check for vacuum leaks and correct as needed. The operator attaches the bags with the limbs therein to a manifold. After all positions on the manifold are filled, the operator then places the manifold with bagged products in preheated (e.g. 300° F.) oven for specified time (e.g. 15 minutes). The operator removes the manifold from the oven, and removes bagged products from manifold. The operator removes wrapped limbs from plastic bags and strips off the transfer fabric. The operator finally inspects the limbs and moves them to the next operation.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The invention claimed is:

1. A method for surface treating multiple surfaces of a three dimensional archery product comprising:

providing a three dimensional archery product including a first region, a second region and a transition region between the first and second regions;

applying a first powder coat layer having a first color in the first region so that the first powder coat layer has a first thickness in the first region;

applying the first powder coat layer in the transition region so that the first powder coat layer has a second thickness in the transition region, the second thickness being less than the first thickness and diminishing toward the second region;

applying a second powder coat layer in the second region so that the second powder coat layer has a third thickness in the second region;

applying the second powder coat layer in the transition region so that the second powder coat layer has a fourth thickness that diminishes toward the first region in the transition region, and so that the second powder coat layer is located above the first powder coat layer relative to the archery product in the transition region;

baking the first powder coat layer and the second powder coat layer located in the first, second and transition regions;

transfer printing a decorative pattern layer in the second region and in the transition region so that the decorative pattern layer is located above the second powder coat layer in the second region relative to the archery product, so that the decorative pattern layer is located above both the first powder coat layer and the second powder coat layer in the transition region relative to the archery product, and so that the second powder coat layer is located between the decorative pattern layer and the first powder coat layer in the transition region, wherein the decorative pattern layer appears to fade into the first color, within the transition region, so that the first color becomes more perceivable toward the first region and the decorative pattern layer becomes less perceivable toward the first region, when the three dimensional archery product is viewed by a viewer.

2. The method of claim 1 wherein the transfer printing is performed by a sublimation process wherein the decorative pattern layer is transferred at least one of onto and into the second powder coat layer.

3. The method of claim 1 wherein the transfer printing is performed by a water immersion process wherein the decorative pattern layer is transferred onto the second powder coat layer.

4. The method of claim 2 wherein the second powder coat layer is at least one of transparent and translucent.

5. The method of claim 4 wherein the first color is a solid color and the decorative pattern layer includes a camouflage pattern.

6. The method of claim 5 wherein the archery product is a bow riser constructed from aluminum.

7. The method of claim 4 comprising applying a base powder coat layer to the archery product in the second region before said applying the second powder coat layer step so that said second powder coat layer is above the base powder layer relative to the archery product.

8. The method of claim 2 wherein the second powder coat layer has a second color different from the first color, wherein the archery product includes a substrate surface that is dark and, wherein the second color is less dark than the substrate surface.

9. The method of claim 3 comprising applying a third powder coat layer that is at least one of transparent and translucent over the decorative pattern layer in the second region and the transition region and baking the third powder coat layer.

10. The method of claim 1 wherein the first powder coat layer is applied directly to a substrate surface of the archery product in the first region and the transition region, wherein the second powder coat layer is applied directly to the substrate surface of the archery product in the second region, and wherein the second powder coat layer is applied directly on and overlays the first powder coat layer in the transition region.

11. The method of claim 1 wherein the second powder coat layer is applied so that the fourth thickness of the second powder coat layer in the transition region is less than the third thickness of the second powder coat layer in the second region.

12. The method of claim 1 wherein the archery product is non-metallic and comprising applying an electrically conductive coating on the non-metallic archery product before said applying a first powder coat layer step.

13. The method of claim 1 wherein the second thickness diminishes at a constant rate.

14. The method of claim 1 wherein the archery product is at least one of a bow, a bow riser, a bow limb, a bow cam, a bow pulley, a cam system, a limb pocket, a rest, a sight, a quiver, a stabilizer, an arrow, a broad head, a field point, a release, a bolt, a stock, and a forearm.

15. The method of claim 1 wherein at least one of the first powder coat layer and the second powder coat layer is applied by electrostatic deposition.

16. A method for surface treating surfaces of an archery product comprising:

providing an archery product including a first region, a second region and a transition region between the first and second regions;

applying a first powder coat layer that is of a first color in the first region;

applying the first powder coat layer in the transition region;

applying a second powder coat layer that is at least one of a second color and transparent;

applying the second powder coat layer in the transition region so that the second powder coat layer is located above the first powder coat layer relative to the archery product in the transition region;

baking the first powder coat layer;

baking the second powder coat layer; and transfer printing a decorative pattern layer in the second region and in the transition region so that the decorative pattern layer is located above the first powder coat layer in the transition region relative to the archery product, wherein the decorative pattern layer appears to fade into the first color in the transition region, so that the first color becomes more perceivable toward the first region and the decorative pattern layer becomes less perceivable toward the first region, when the archery product is viewed by a viewer, whereby a first portion of the archery product appears to include the first color and a second portion of the archery product appears to include the decorative pattern layer.

17. A method for surface treating multiple surfaces of a three dimensional product comprising:

providing a three dimensional product including a first region, a second region and a transition region between the first and second regions;

applying a first powder coat layer having a first color in the first region so that the first powder coat layer has a first thickness in the first region;

applying the first powder coat layer in the transition region so that the first powder coat layer has a second thickness in the transition region, the second thickness being less than the first thickness and diminishing toward the second region;

applying a second powder coat layer in the second region so that the second powder coat layer has a third thickness in the second region;

applying the second powder coat layer in the transition region so that the second powder coat layer has a fourth thickness that diminishes toward the first region in the transition region, and so that the second powder coat layer is located above the first powder coat layer relative to the archery product in the transition region;

baking the first powder coat layer and the second powder coat layer located in the first, second and transition regions; and transfer printing a decorative pattern layer in the second region and in the transition region so that the decorative pattern layer is located above the second powder coat layer in the second region relative to the archery product, so that the decorative pattern layer is located above both the first powder coat layer and the second powder coat layer in the transition region relative to the archery product, and so that the second powder coat layer is located between the decorative pattern layer and the first powder coat layer in the transition region, wherein the decorative pattern layer appears to fade into the first color, within the transition region, so that the first color becomes more perceivable toward the first region and the decorative pattern layer becomes less perceivable toward the first region, when the three dimensional archery product is viewed by a viewer.

18. The method of claim 16 wherein the transfer printing is performed by at least one of (a) a sublimation process wherein the decorative pattern layer is transferred at least one of onto and into the second powder coat layer, and (b) a water immersion process wherein the decorative pattern layer is transferred onto the second powder coat layer.

19. The method of claim 16 wherein at least one of the first powder coat layer and the second powder coat layer is applied by electrostatic deposition.

* * * * *